US012383048B2

(12) United States Patent
Yadav et al.

(10) Patent No.: US 12,383,048 B2
(45) Date of Patent: Aug. 12, 2025

(54) WEARABLE TISSUE RECEPTACLE

(71) Applicant: Sachin Yadav, Saratoga, CA (US)

(72) Inventors: Sachin Yadav, Saratoga, CA (US); Rajeev Kumar, Gandhinagar (IN); Tiana Yadav, Saratoga, CA (US)

( * ) Notice: Subject to any disclaimer, the term of this patent is extended or adjusted under 35 U.S.C. 154(b) by 67 days.

(21) Appl. No.: 18/187,187

(22) Filed: Mar. 21, 2023

(65) Prior Publication Data

US 2023/0218070 A1 Jul. 13, 2023

Related U.S. Application Data

(60) Provisional application No. 63/269,744, filed on Mar. 22, 2022.

(51) Int. Cl.

| | |
|---|---|
| ***A45F 5/04*** | (2006.01) |
| ***A45F 5/00*** | (2006.01) |
| ***B65D 83/08*** | (2006.01) |

(52) U.S. Cl.

CPC ..... *A45F 5/00* (2013.01); *B65D 83/0888* (2013.01); *B65D 83/0894* (2013.01); *A45F 2005/008* (2013.01)

(58) Field of Classification Search

CPC ..... A47K 10/421; A47K 2010/3266; A47K 10/422; B65H 2402/411; B65H 1/00; B65H 2402/41; B65H 1/04; A45F 2005/008; A45F 5/04; A45C 2011/007; A45C 11/008

USPC ..... 224/196, 219, 222

See application file for complete search history.

(56) References Cited

U.S. PATENT DOCUMENTS

| | | | | |
|---|---|---|---|---|
| 2,347,823 | A * | 5/1944 | Goodman | A47K 10/422 312/50 |
| 2,553,676 | A * | 5/1951 | Roos | B42D 5/006 281/51 |
| 4,401,233 | A | 8/1983 | Frey | |
| 4,536,889 | A | 8/1985 | Taylor | |
| 5,358,141 | A | 10/1994 | Carlson | |
| 5,964,375 | A * | 10/1999 | Carlson | B42D 5/005 221/45 |
| 5,979,095 | A | 11/1999 | Schneider | |
| 6,644,694 | B2 * | 11/2003 | Seawright | B42D 15/0086 2/160 |
| 2007/0157354 | A1 | 7/2007 | Lee | |

(Continued)

FOREIGN PATENT DOCUMENTS

| | | |
|---|---|---|
| DE | 4238056 A1 | 5/1994 |
| EP | 3827802 A1 | 6/2021 |

*Primary Examiner* — Adam J Waggenspack

(74) *Attorney, Agent, or Firm* — CIONCA IP Law P.C.

(57) ABSTRACT

A wearable tissue receptacle having: a main unit having: a lower part; and a ribbed bridge disposed on the lower part, the ribbed bridge comprising a plurality of ribs, wherein the ribs form a rounded arch; a strap configured to be attached to the main unit, wherein the strap is configured to secure the main unit to a user; a securing ridge disposed on the main unit and a securing cavity disposed on the main unit, wherein the securing ridge is configured to be selectively engage with the securing cavity to secure a tissue bundle to the main unit. The wearable tissue receptacle is configured to provide an attached user with easy to access to a tissue bundle for wiping their nose, face, etc., which may be replaced quickly and easily. The wearable tissue receptacle may thusly be configured to prevent or reduce the proliferation of germs and viruses.

20 Claims, 14 Drawing Sheets

(56) References Cited

U.S. PATENT DOCUMENTS

| | | | | |
|---|---|---|---|---|
| 2010/0272767 | A1 | 10/2010 | Koele | |
| 2018/0263436 | A1* | 9/2018 | Bartrug | A47K 10/424 |
| 2019/0181396 | A1 | 6/2019 | Burdon | |

* cited by examiner

WEARABLE TISSUE RECEPTACLE

CROSS-REFERENCE TO RELATED APPLICATIONS

This application claims the benefit of U.S. Provisional Application No. 63/269,744, filed Mar. 22, 2022, which is hereby incorporated by reference, to the extent that it is not conflicting with the present application.

BACKGROUND OF INVENTION

1. Field of the Invention

The invention relates generally to tissue receptacles and more specifically to wearable tissue receptacles.

2. Description of the Related Art

One common symptom associated with illness is a runny nose. Exposure to lower temperatures may also cause an individual to have a runny nose, despite the individual not having an illness. While the most commonly accepted solution to treating a runny nose may be the utilization of a tissue to wipe a runny nose, the currently established systems for providing and dispensing tissues may have several shortcomings that hamper their viability. One of the most common tissue distribution apparats is a tissue box or pack. While a tissue box/pack may prove effective for tissue distribution in some situations, a user must be within arm's reach of the tissue box in order to allow for immediate use, potentially requiring a user to carry a tissue box with them from place to place. This may be inconvenient in many scenarios, and impossible in others. For example, a user on a ski slope may experience a runny nose as a result of the cold weather and have to constantly reach into their pocket to access a tissue box/pack for tissues in order to wipe their nose as needed.

Additionally, small children dealing with a runny nose may also present a challenge that may not be overcome through the use of conventional tissue boxes/packs. Small children may reflexively use their wrist or arm to wipe their nose without even attempting to find a tissue box. As such, a tissue box, or any other conventional tissue container would be incapable of remedying this issue, and thus would be incapable of preventing the proliferation of germs through this mechanism.

Therefore, there is a need to solve the problems described above by providing a wearable tissue receptacle capable of providing a conveniently positioned tissue that is available for immediate use.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description.

In an aspect, a wearable tissue receptacle is provided, the wearable tissue receptacle comprising: a main unit having: a lower part; and a ribbed bridge disposed on the lower part, the ribbed bridge having two end portions and a middle portion disposed between the two end portions, the ribbed bridge comprising a plurality of ribs, wherein ribs disposed at the end portions of the ribbed bridge are shorter than ribs disposed at the middle portion of the ribbed bridge, such that the ribbed bridge forms a rounded arch; a strap configured to be attached to the main unit, wherein the strap is configured to secure the main unit to a user; a tissue bundle configured to be engaged with the main unit, the tissue bundle having: at least one tissue layer comprising: a tissue body portion; a waste portion associated with the tissue body portion; a tissue tab associated with the tissue body portion, the tissue tab being configured to be manipulated by the user to separate the tissue body portion from the waste portion; wherein the tissue bundle is configured to be seated on the ribbed bridge; and a securing ridge disposed on the main unit and a securing cavity disposed on the main unit, wherein the securing ridge is configured to be selectively, partially nested within the securing cavity to secure the tissue bundle to the main unit. Thus, an advantage is that a user may easily wipe their nose or face on the tissue bundle held by the wearable tissue receptacle without a need to physically carry anything in their hands. Another advantage is that ribbed bridge on the lower part may provide a smooth wiping surface to a user that may still grip the tissue bundle to prevent it from sliding or tearing unintentionally during use. Another advantage is that the ribbed bridge may increase the flexibility of the main unit while providing superior ventilation to the held tissue bundle. Another advantage is that the main unit and strap may be separable, allowing the main unit and strap to be swapped out for different main units and straps, accordingly, allowing a user to customize the wearable tissue receptacle. Another advantage is that the main unit of the wearable tissue receptacle may be configured to allow a user to easily remove a soiled tissue layer from the secured wearable tissue bundle using an associated unsoiled tissue tab, thus allowing the user to dispose of potential contaminants while keeping their hands clean. Another advantage is that the main unit may also be configured to allow a user to easily remove and replace a depleted tissue bundle without ever having to come in contact with the soiled tissue.

In another aspect a wearable tissue receptacle is provided, the wearable tissue receptacle comprising: a main unit having: a lower part; and a ribbed bridge disposed on the lower part, the ribbed bridge having two end portions and a middle portion disposed between the two end portions, the ribbed bridge comprising a plurality of ribs, wherein ribs disposed at the end portions of the ribbed bridge are shorter than ribs disposed at the middle portion of the ribbed bridge, such that the ribbed bridge forms a rounded arch; a strap configured to be attached to the main unit, wherein the strap is configured to secure the main unit to a user; a securing ridge disposed on the main unit and a securing cavity disposed on the main unit, wherein the securing ridge is configured to be selectively engaged with the securing cavity to secure a tissue bundle to the main unit. Again, an advantage is that a user may easily wipe their nose or face on a tissue bundle held by the wearable tissue receptacle without a need to physically carry anything in their hands. Another advantage is that ribbed bridge on the lower part may provide a smooth wiping surface to a user that may still grip a tissue bundle to prevent it from sliding or tearing unintentionally during use. Another advantage is that the ribbed bridge may increase the flexibility of the main unit while providing superior ventilation to a held tissue bundle.

Another advantage is that the main unit and strap may be separable, allowing the main unit and strap to be swapped out for different main units and straps, accordingly, allowing a user to customize the wearable tissue receptacle. Another advantage is that the main unit of the wearable tissue receptacle may be configured to allow a user to easily remove a soiled tissue layer from a secured wearable tissue bundle using an associated unsoiled tissue tab, thus allowing the user to dispose of potential contaminants while keeping their hands clean. Another advantage is that the main unit may also be configured to allow a user to easily remove and replace a depleted tissue bundle without ever having to come in contact with the soiled tissue.

In another aspect a wearable tissue receptacle is provided, the wearable tissue receptacle comprising: a main unit having: a lower part; and a bridge disposed on the lower part; a strap configured to be attached to the main unit, wherein the strap is configured to secure the main unit to a user; a securing ridge disposed on the main unit and a securing cavity disposed on the main unit, wherein the securing ridge is configured to be selectively engaged with the securing cavity to secure a tissue bundle to the main unit. Again, an advantage is that a user may easily wipe their nose or face on a tissue bundle held by the wearable tissue receptacle without a need to physically carry anything in their hands. Another advantage is a bridge may be provided on the lower part to provide a smooth wiping surface for a user that may still grip a tissue bundle to prevent it from sliding or tearing unintentionally during use. Another advantage is that said bridge may increase the flexibility of the main unit while providing superior ventilation to a held tissue bundle. Another advantage is that the main unit and strap may be separable, allowing the main unit and strap to be swapped out for different main units and straps, accordingly, allowing a user to customize the wearable tissue receptacle. Another advantage is that the main unit of the wearable tissue receptacle may be configured to allow a user to easily remove a soiled tissue layer from a secured wearable tissue bundle using an associated unsoiled tissue tab, thus allowing the user to dispose of potential contaminants while keeping their hands clean. Another advantage is that the main unit may also be configured to allow a user to easily remove and replace a depleted tissue bundle without ever having to come in contact with the soiled tissue.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1A:
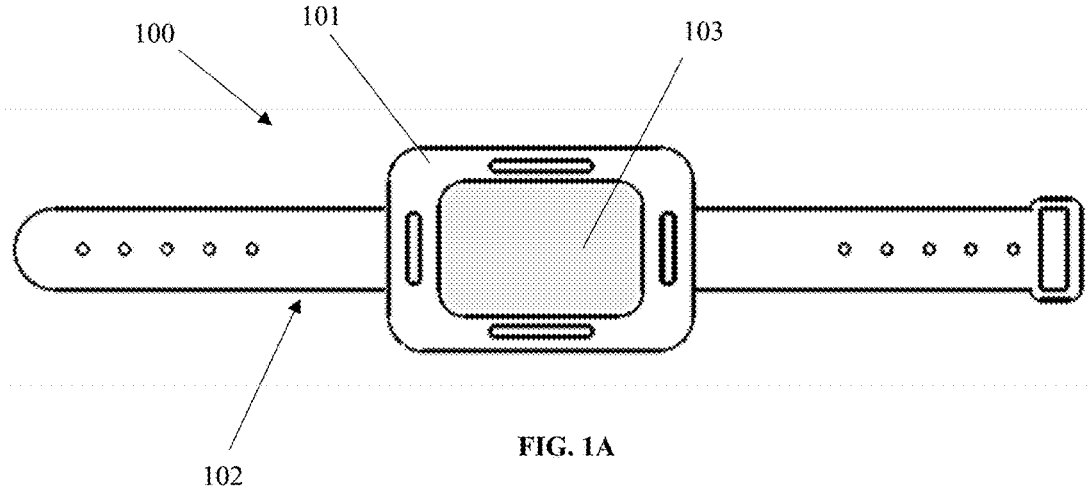
FIG. 1A illustrates the top view of the disclosed wearable tissue receptacle, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 104 and 204, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

Figure 1B:
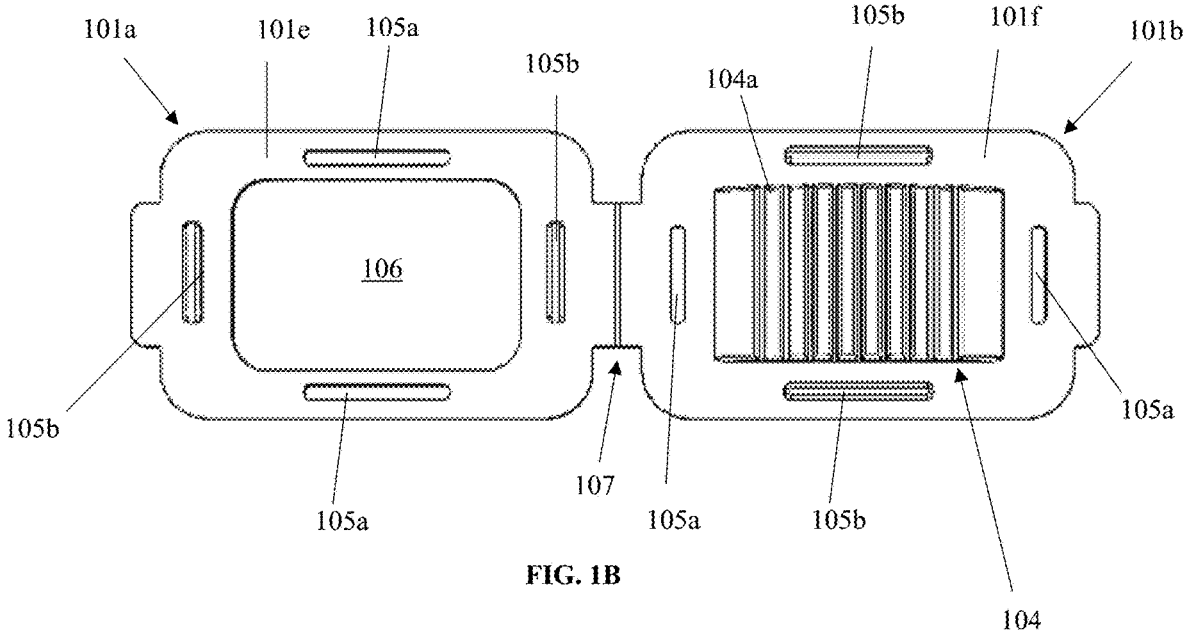
FIG. 1B illustrates the top view of the main unit of a wearable tissue receptacle, according to an aspect.
Figure 1C:
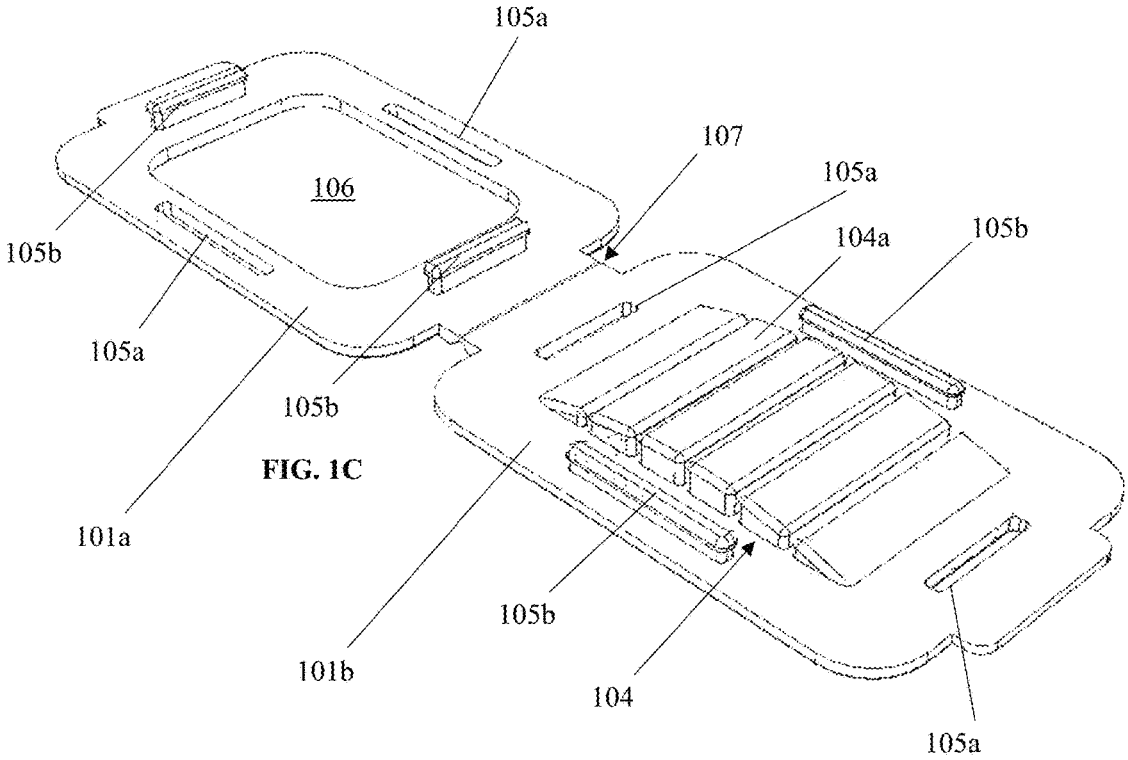
FIG. 1C illustrates the top perspective view of the main unit of a wearable tissue receptacle, according to an aspect.
Figure 1D:
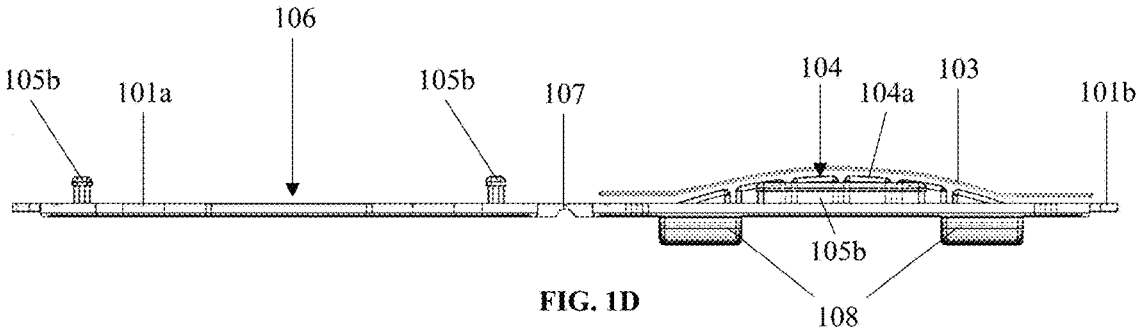
FIG. 1D illustrates the side profile view of the main unit of a wearable tissue receptacle, according to an aspect.
Figure 1E:
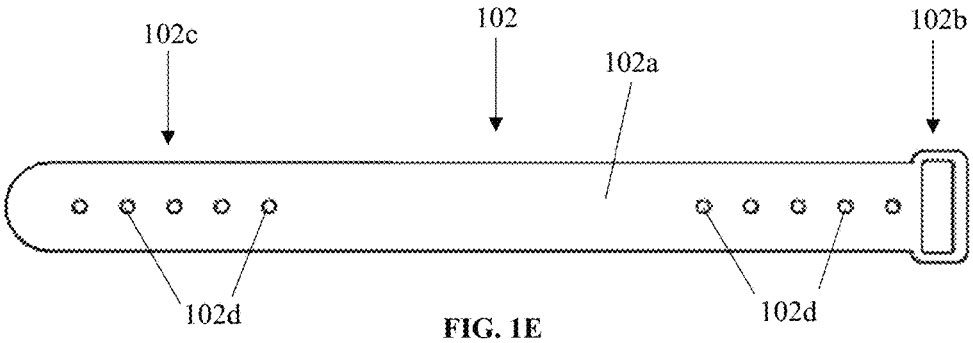
FIG. 1E illustrates the top view of a strap of a wearable tissue receptacle, according to an aspect.

FIG. 1A illustrates the top view of the disclosed wearable tissue receptacle 100, according to an aspect. FIG. 1B illustrates the top view of the main unit 101 of a wearable tissue receptacle 100, according to an aspect. FIG. 1C illustrates the top perspective view of the main unit 101 of a wearable tissue receptacle 100, according to an aspect. FIG. 1D illustrates the side profile view of the main unit 101 of a wearable tissue receptacle 100, according to an aspect. FIG. 1E illustrates the top view of a strap 102 of a wearable tissue receptacle 100, according to an aspect. The disclosed wearable tissue receptacle 100 is configured to provide an attached user (not shown) with fast and easy access to a tissue without requiring the user to hold said tissue within their hand. The wearable tissue receptacle 100 may be comprised of three core components: a main unit 101, a strap 102 and a tissue bundle 103 such as a tissue stack/cartridge, such as tissue stack 616 of FIG. 6F or tissue cartridge 822 of FIG. 8A. The herein disclosed wearable tissue receptacle 100 may be used not only to wipe one's nose or face, but also to cover one's sneeze or cough as necessary to prevent the proliferation of germs.

The main unit 101 may be comprised of an upper part 101*a* and a lower part 101*b*. In an embodiment, the upper part 101*a* may be pivotally attached to the lower part 101*b* by a junction hinge 107. The upper part 101*a* may be configured to be rotated about said junction hinge 107 in order to allow the upper part 101*a* to engage with the lower part 101*b*, as will be described in greater detail hereinbelow. The upper part 101*a* may have an upper part body 101*e* and a tissue window 106 centrally disposed within the upper part body 101*e*, the tissue window 106 configured to allow the attached user to rub their nose or face on a tissue bundle 103 secured between the upper part 101 and the lower part 101*b*. As such, the tissue window 106 may operate as a through hole through the upper part body 101*e* that exposes an internally held tissue bundle 103 to the user. The upper part 101*a* of the main unit 101 may also have securing ridges 105*b* attached to the upper part body 101*e*, wherein said securing ridges 105*b* are configured to be inserted in securing cavities 105*a* nested or otherwise disposed within a lower part body 101*f*, while also having securing cavities 105*a* nested or otherwise disposed within the upper part body 101*e* that are configured to receive securing ridges 105*b* attached to the lower part body 101*f*. For simplicity, it may be stated that securing cavities and securing ridges may be nested within/disposed on the upper part 101*a* and/or lower part 101*b*, accordingly.

By selectively inserting securing ridges 105*b* on the upper part 101*a* and lower part 101*b* into corresponding securing cavities 105*a* nested or otherwise disposed within the lower part 101*b* and upper part 101*a*, respectively, the user may selectively engage the upper part 101*a* with the lower part 101*b* to sandwich a tissue bundle 103 (e.g., tissue stack/tissue cartridge) within the wearable tissue receptacle 100 to enable its utilization by the attached user. It should be understood that comparable securing mechanisms, such as snaps or clips, may also be used in order to secure the upper part 101*a* of the main unit 100 to the lower part 101*b* of the main unit 100.

The lower part 101*b* may be comprised a lower part body 101*f*. The main unit 101 may be further comprised of a ribbed bridge 104 disposed on the lower part 101*b*, or more specifically the lower part body 101*f*. The ribbed bridge 104 may be comprised of a plurality of ribs 104*a*, wherein said ribbed bridge 104 is configured to form a rounded arch on which a tissue bundle 103 is seated when said tissue bundle 103 is secured within the main unit 101, thus supporting said tissue bundle 103 from below. As such, a tissue bundle 103 supported by the ribbed bridge 104 may in turn conform to the shape of the rounded arch. The ribs 104*a* of the ribbed bridge 104 may be associated with the lower part 101*b* of the main unit 101, such that upon seating of a tissue bundle 103 on the ribbed bridge 104 and engaging of lower part 101*b* with the upper part 101*a*, the tissue bundle 103 smoothly protrudes out of the tissue window 106 of the upper part 101*a*, to facilitate easy access to said tissue bundle 103 by the attached user. As can be seen in FIGS. 1B-1C, the ribs 104*a* of the ribbed bridge 104 may be provided in various sizes, which will be discussed in greater detail hereinbelow. As described hereinabove, the main unit 101 may be further comprised of a plurality of securing ridges 105*b* attached to the lower part 101*b* or lower part body 101*f* and a plurality of securing cavities 105*a* disposed or nested within the lower part 101*b* lower part body 101*f*, wherein the securing ridges 105*b* and securing cavities 105*a* of the lower part 101*b* are configured to engage with corresponding securing cavities 105*a* and securing ridges 105*b*, respectively, on the upper part 101*a*, in order to secure the upper part 101*a* and the lower part 101*b* together.

By disengaging each securing ridge 105*b* from its corresponding securing cavity 105*a*, the upper part 101*a* may be selectively rotated about the junction hinge 107 to allow for removal and replacement of used tissues. Due to the fact that the securing ridges 105*b* and securing cavities may be used interchangeably on the upper part 101*a* and lower part 101*b*, it may be stated that the wearable tissue receptacle 100 may be comprised of at least a securing ridge 105*b* disposed on the main unit 101 and a securing cavity 105*a* disposed on the main unit 101, wherein the securing ridge 105*b* is configured to be selectively, partially nested within or otherwise engaged with the securing cavity 105*a* to secure the tissue bundle 103 to the main unit 101. It should be understood that the quantity and positioning of securing cavities 105*a* and securing ridges 105*b* utilized may be varied, as long as each securing ridge 105*b* is configured to engage with a corresponding securing cavity 105*a*.

The shapes of the tissue window 106 and the ribbed bridge 104 may be complementary, such that the ribbed bridge 104 and a seated tissue bundle 103 smoothly protrude through the tissue window to allow a user to wipe their nose or face on the tissue sandwiched between the upper part 101*a* and the lower part 101*b*. It should be understood that the term "protrude smoothly" may refer to the ribbed bridge having a rounded profile without any large or abrupt changes in direction, creating a rounded, mostly smooth surface as seen by ribbed bridge 104 of FIGS. 1C-1D. The tissue window 106 may have a rectangular shape with rounded edges. This shape of tissue window 106 may optimize the ratio of tissue surface area sandwiched between the upper and lower parts to the tissue surface area protruding out of the tissue window 106 for direct usage. By optimizing said ratio, the tissue bundle 103 may be firmly secured to the main unit 101 while leaving a sufficiently large area of the tissue bundle 103 exposed for a user to wipe their nose or face on.

Figure 4A:
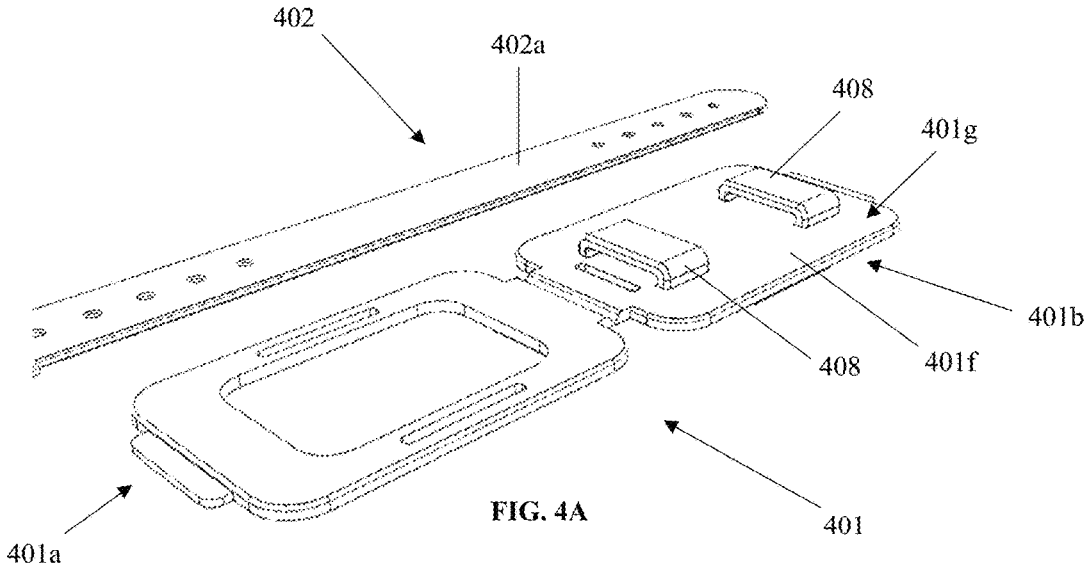
FIG. 4A illustrates the bottom perspective view of a main unit having strap loops, according to an aspect.

In order to secure the main unit 101 to a user, the main unit 101 may be configured to attach to a strap 102. The strap 102 may be comprised of a strap body 102*a* configured to wrap around and engage with a user's wrist or arm in order to attach itself to the user. The head end 102*b* of the strap 102 may be configured to attach to a tail end 102*c* of the strap 102 in order to suitably secure the strap 102 to the main unit 101 and the user. The mechanism through which the head end 102*b* engages with the tail end 102*c* may be Velcro or a comparable loop-hook fastener, as seen in FIG. 4A, a rivet fastener, such as rivet fastener 512 of FIG. 5B, configured to engage with one of a plurality of fastening through holes 102*d* in the tail end 102*c* of the strap 102, or any other suitable junction method configured to provide a firm, but reversible engagement. The main unit 101 may be attached to the strap 102 through the insertion or partial nesting of the strap body 102*a* through/within the strap loops 108 disposed on the lower part 101*b* of the main unit 101, or said strap 102 may be integrated directly into or directly associated with the main unit 101, as seen by wearable tissue receptacles 500 of FIGS. 5A-5B.

Figure 8A:
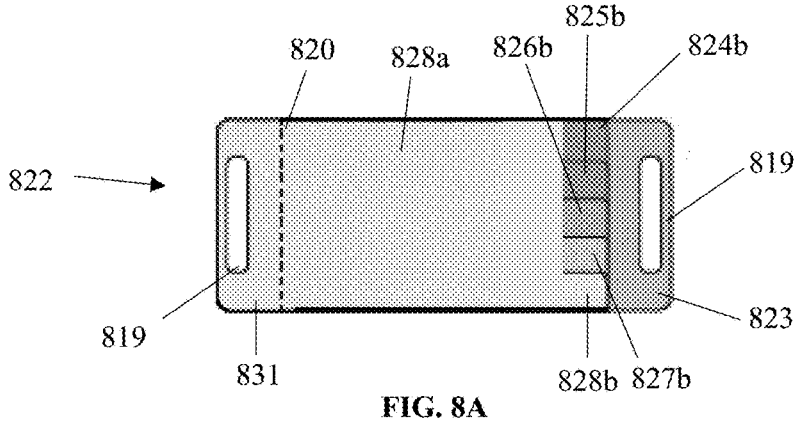
FIG. 8A illustrates the top view of a tissue cartridge, according to an aspect.

The main unit 101 and the strap 102 of the wearable tissue receptacle 100 may be comprised of suitable materials to ensure the resulting wearable tissue receptacle 100 is lightweight, bendable and comfortable to use and wear. The main unit 101 may be comprised of a suitable material, such as a lightweight plastic or silicone, in order to provide the necessary structure to house tissue bundles 103 such as tissue stacks or cartridges and support said tissues for utilization by the user, while comfortably conforming to the shape of a user's wrist or arm. The strap 102 may be comprised of a lightweight bendable material, such as plastic or silicone, that is comfortable for a child or adult to wear, while being flexible and resistance to breakage. The tissue bundle 103 housed within the main unit will be described in greater detail hereinbelow. It should be understood that a tissue stack, such as tissue stack 616 of FIG. 6F, and a tissue cartridge, such as tissue cartridge 822 of FIG. 8A are both types of tissue bundles 103 that may be used with the disclosed wearable tissue receptacle 100, and that each tissue bundle 103 may be comprised of at least one tissue layers or tissue sections. As such, even a singular convention tissue may be classified as a type of tissue bundle 103.

Figure 2A:
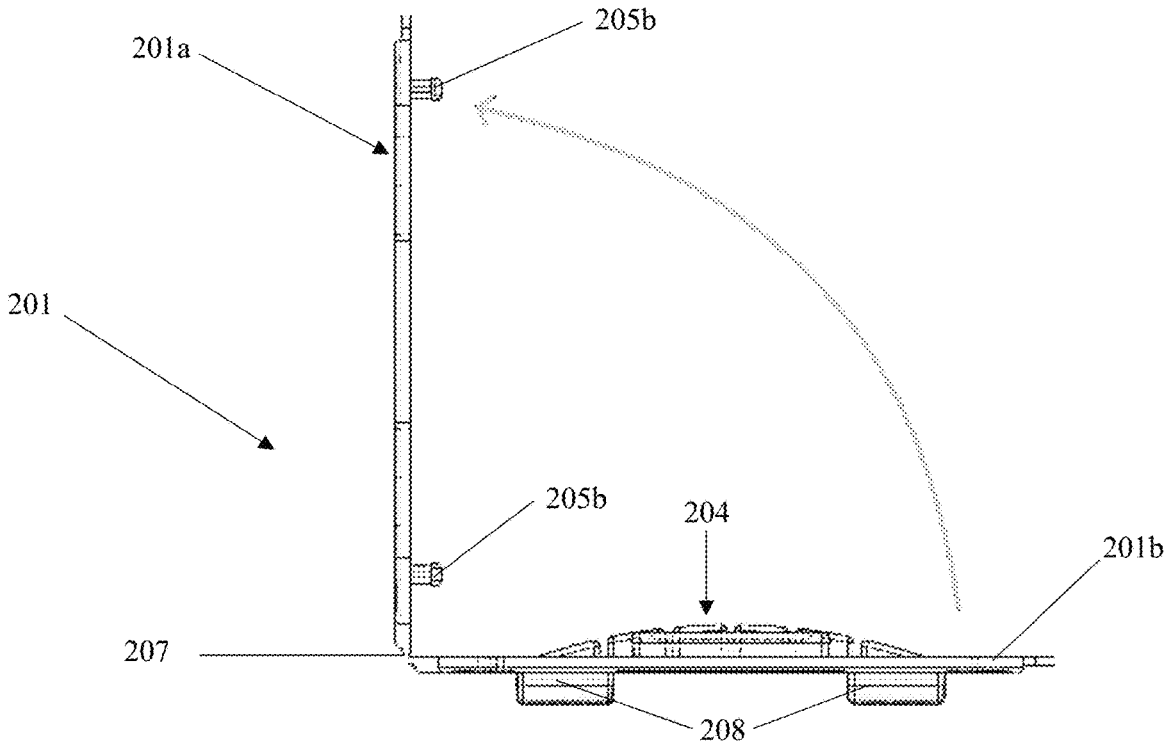
FIG. 2A illustrates the side profile view of fully opened main unit, according to an aspect.
Figure 2B:
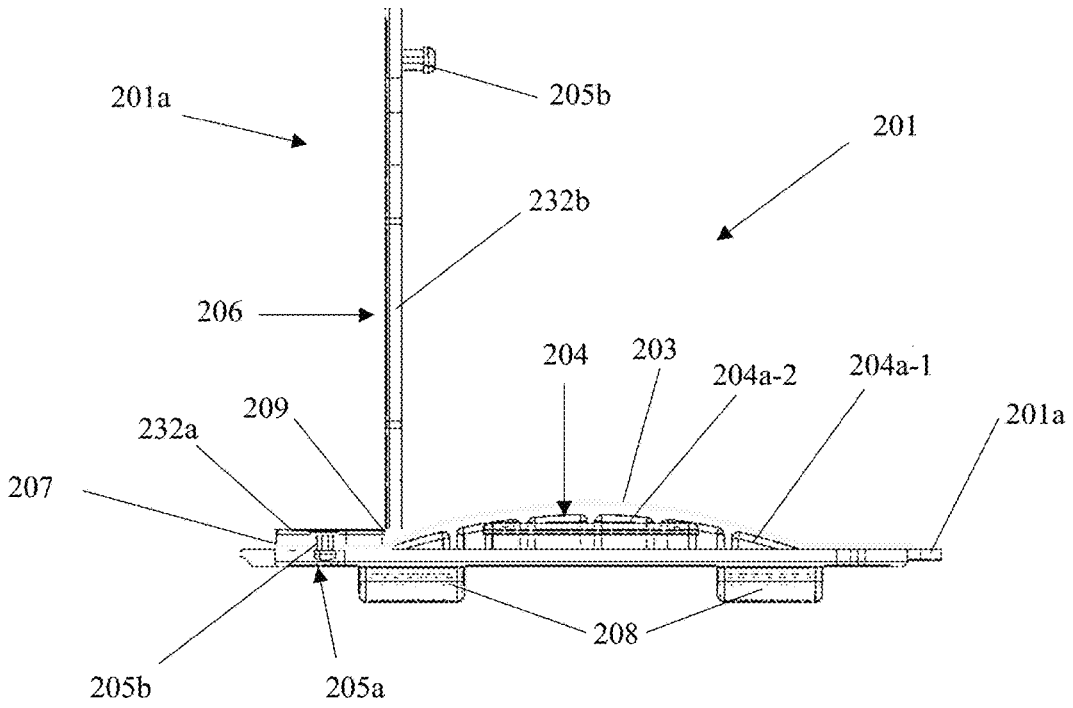
FIG. 2B illustrates the side profile view of a partially opened main unit, according to an aspect.

FIG. 2A illustrates the side profile view of fully opened main unit 201, according to an aspect. FIG. 2B illustrates the side profile view of a partially opened main unit 201, according to an aspect. As can be seen in FIGS. 2A-2B, the upper part 201*a* may be pivotally attached to the lower part 201*b* by a junction hinge 207 in order to allow the disengagement of each securing ridge 205*b* from each corresponding securing cavities 205*a*, to allow the main unit 201 to be fully opened to remove or replace the secured tissue bundle 203, while still keeping the upper part 201*a* and lower part 201*b* attached to each other. As will be discussed in greater detail hereinbelow, a tissue stack or cartridge having perforations in each tissue section or layer may be secured within the main unit 201, such that each tissue section/layer may be easily torn off.

In addition to the hereinabove described junction hinge 207, the upper part 201*a* may be further comprised of a release hinge 209 configured to allow a user to remove a tissue section, such as tissue section 618*a* of FIG. 6B, from the tissue bundle 203 by its perforations, while leaving the remainder of tissues sections secured within the main unit 201. As such, the upper part 201*a* may be comprised of a mounted portion pivotally attached to the bottom portion by the junction hinge 207, and a rotating portion 232*b* pivotally engaged with the mounted portion 232*a* by a release hinge 209. The release hinge 209 may be disposed between a mounted portion 232*a* of the upper part 201*a* and rotating portion 232*b* of the upper part 201*a*, to facilitate this pivotal engagement. As such, when the rotating portion 232*b* is rotated about the release hinge 209 as depicted in FIG. 2B, such that only the securing ridge 205*b* on the mounted portion 232*a* is engaged with a corresponding securing cavity 205*a* in the lower part 201*b*, the main unit 201 may be described as partially opened. The prior described tissue window 206 may be solely disposed on the rotating portion 232*b*.

As described hereinabove while the main unit 201 is partially opened, the release hinge 209 may keep a single securing ridge 205*b* of the upper part 201*a* engaged with a single securing cavity 205*a* of the lower part 201*b*, as seen in FIG. 2B. This engagement allows the secured tissue bundle 203 to remain secured to the main unit 201, while still allowing easy access to the outermost tissue section of said tissue bundle 203. As discussed hereinabove, while the main unit 201 is partially opened, a user may easily remove an outermost tissue section of the tissue bundle 203 by tearing a corresponding outermost tissue section about its perforations, such as perforation 820 of FIG. 8G. A tissue stack, such as tissue stack 616 of FIG. 6F, may be configured to align the perforations 620 on each of its tissue sections 618*a* with the release hinge 209 to allow for easy, selective removal of soiled tissue sections, while leaving the remaining tissue sections of the tissue bundle 203 secured within the main unit 201. The tissue bundle 203, and its various embodiments, such as tissue stack 616 of FIG. 6F and tissue cartridge 822 of FIG. 8A, will be discussed in greater detail hereinbelow. The lower part 201*b* of the main unit 201 may be further comprised strap loops 208 disposed on a bottom surface of the lower part 201*b*, which will also be discussed in greater detail hereinbelow.

Figure 3A:
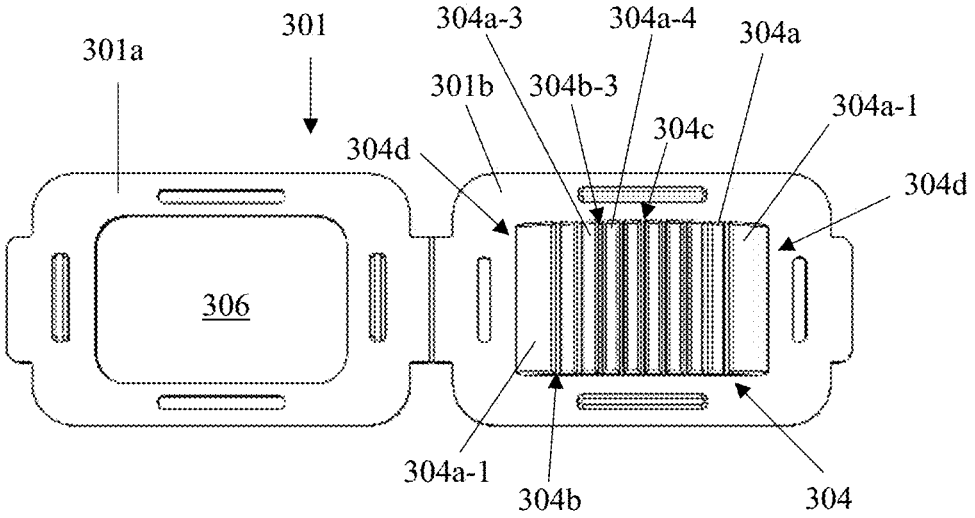
FIG. 3A illustrates the top view of a main unit having narrower ribs, according to an aspect.
Figure 3B:
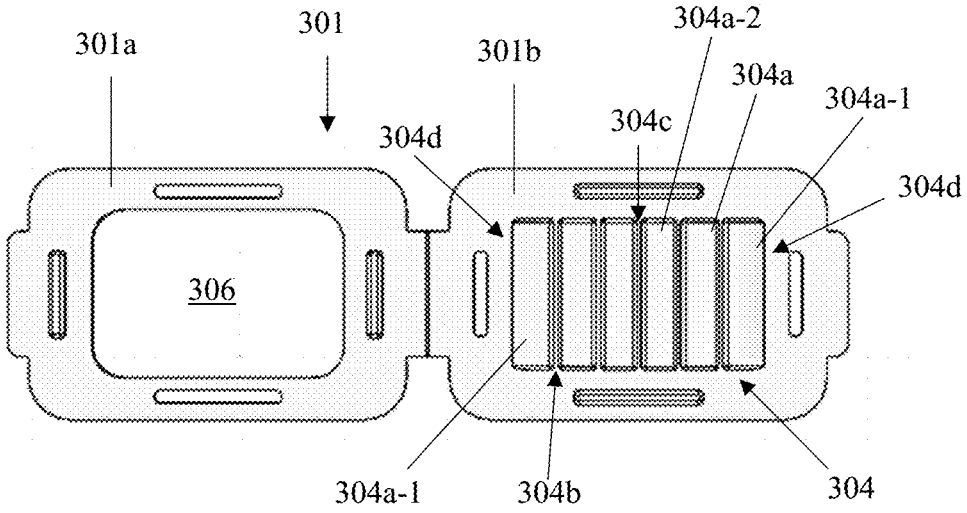
FIG. 3B illustrates the top view of a main unit having wider ribs, according to an aspect.

FIG. 3A illustrates the top view of a main unit 301 having narrow ribs 304*a*, according to an aspect. FIG. 3B illustrates the top view of a main unit 301 having wide ribs 304*a*, according to an aspect. As can be seen in FIG. 3A and FIG. 3B, the dimensions and quantity of each rib 304*a* of the ribbed bridge 304 may be varied. In an embodiment, such as the main unit 301 seen in FIG. 3A, each rib 304*a* of the ribbed bridge 304 may be narrow, such that there are ten ribs 304*a* included in the ribbed bridge 304. In an alternative embodiment, such as the main unit 301 seen in FIG. 3B, each rib 304*a* may be wide, such that there are only six ribs 304*a* included in the ribbed bridge 304.

It should be understood that regardless of the dimensions or quantities of ribs 304*a* included in the ribbed bridge 304, said ribbed bridge 304 is configured such that said ribs 304*a* fit within the tissue window 306 of the upper part 301*a* of the main unit 301 upon engagement of the upper part 301*a* with the lower part 301*b*, such that any tissue(s) seated on the ribbed bridge 304 may suitably protrude out of the tissue window 306 to be easily accessed by the user, while remaining secured to the main unit 301. As can be seen in FIGS. 2A-3B the ribbed bridge 204, 304 may have a slightly curved profile such that it creates a rounded arch shape, wherein the ribs 204*a*-1, 304*a*-1 disposed at end portions 304*d* of the ribbed bridge 304 are shorter than the ribs 204*a*-2, 304*a*-2 disposed in the portion middle 304*c* of the ribbed bridge 304, such that an attached tissue bundle 203 protrudes a greater distance out of the tissue window at the middle portion 304*c* of the ribbed bridge than at its end portions 304*d* upon engagement of the upper part 301*a* with the lower part 301*b*, thus creating a smoothly contoured and easy to access wiping surface for a user. In other words, the protrusion of the ribbed bridge 304 or any other suitable bridge may be the greatest (protrudes further) at the middle portion 304*c* of the bridge 304, and the least at the end portions 304*d* of the bridge 304

When utilizing thinner tissue layers with the disclosed wearable tissue receptacle (e.g., tissue layers with a lower GSM), it may be preferred to utilize a ribbed bridge 304 having a greater quantity of ribs 304*a*, such that each rib 304*a* is narrow, as seen in FIG. 3A. A ribbed bridge 304 having a greater quantity of narrower ribs 304 is configured to exert less surface tension on a tissue layer secured within the main unit 301 than a ribbed bridge having fewer, wider ribs 304*a*, as seen in FIG. 3B. By exerting less surface tension on a secured tissue layer, unwanted breakages in said tissue layer may be avoided, even with thinner tissue layers or tissue layers made of weaker materials.

One of the main purposes of the ribbed bridge 304 is to reduce the tension experienced on the tissue layer during wiping, while simultaneously having the tissue layer smoothly protrude out of the tissue window 306 for easy access by the user. By providing a ribbed bridge 304 having a plurality of contact points with the secured tissue bundle, the tension experienced by said tissue layers during use may be roughly equalized over the area of the tissue layer, thus reducing the likelihood of unwanted breakages, while simultaneously gripping the tissue bundle to reduce the likelihood of the tissue bundle moving during use. This ribbed bridge 304 may also create a relatively smooth surface for the user to wipe their nose or face against, thus ensuring the user is not uncomfortable while wiping their nose/face. The ribbed bridge 304 may also increase the flexibility of the main unit as a result of the rib gap ("space") 304*b* between the ribs 304*a* of the ribbed bridge 304. These rib gaps 304*b* disposed between the ribs also allow air to travel through the ribbed bridge 304, thus providing superior air permeability to allow used or otherwise wet tissue layers to dry more rapidly, helping to reduce or prevent the proliferation of moisture between tissues, tissue sections or tissue layers. It should be understood that a rib gap 304*b* may be disposed between any pair of adjacent ribs 304*a*, as seen in FIG. 3A-3B. such that each rib 304*a* is adjacent to at least on rib gap 304*b*. In other words, each pair of adjacent ribs, such as third rib 304*a*-3 and fourth rib 304*a*-4 may be separated by a third rib gap 304*b*-3 disposed between them, as seen in FIG. 3A.

It should be understood that while the ribbed bridges 304 disclosed herein may be shown as being comprised of a plurality of ribs throughout the disclosure, variations of this ribbed bridge 304 may be implemented as necessary or desirable, depending on the specific application of the wearable tissue receptacle. In an alternative embodiment, the ribbed bridge 304 may be provided as a singular monolithic structure (e.g., comprised of one, singular ridge) and may be referred to simply as a bridge. This alternative, monolithic bridge may have a curved shape that follow the same curvature as the ribbed bridges 304 of FIG. 3A-3B disclosed herein. This alternative embodiment of the ridge may span the same length on the main unit 301, such that the bridge 304 still protrudes through the tissue window 306 upon engagement of the upper part 301*a* with the lower part 301*b*.

A monolithic bridge comprised of a singular rib may still be able to comfortably flex around the curvature of a user's wrist, as long as the bridge is comprised of a suitable flexible material, such as silicone. It should be understood that additional features, such as ventilation holes (not shown), may be nested within this monolithic embodiment of the bridge 304 in order to provide sufficient air flow for the tissue bundle, similarly to the rib gaps 304*b* disclosed hereinabove. It should be understood that various different modifications may be made to the bridge 304 of the main unit 301, as long as the bridge 304 is configured to sufficiently support the tissue bundle and allow the tissue bundle to be accessed and used by the user.

Figure 4B:
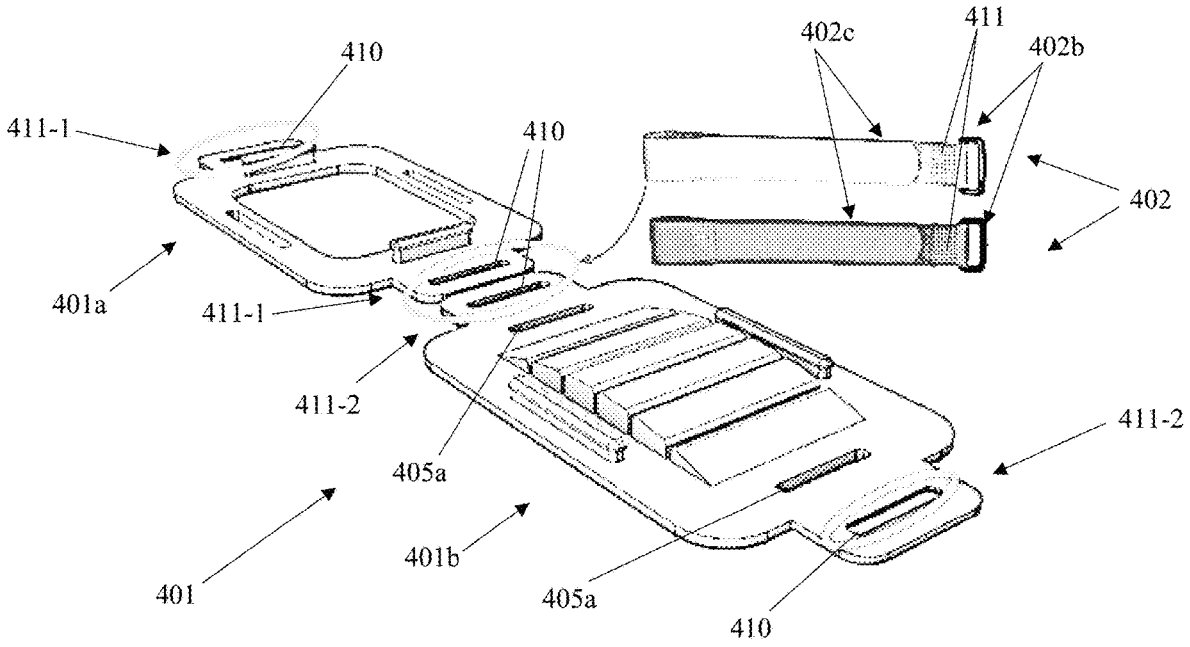
FIG. 4B illustrates the top perspective view of a main unit having strap through holes, according to an aspect.

FIG. 4A illustrates the bottom perspective view of a main unit 401 having strap loops 408, according to an aspect. FIG. 4B illustrates the top perspective view of a main unit 401 having strap through holes 410, according to an aspect. The herein described main unit 401 and the strap 402 may be provided with complementary securing elements to facilitate their interconnection. Similarly to the main unit 201 seen in FIG. 2A, the main unit 401 of FIG. 4A may have strap loops 408 secured to a bottom surface 401*g* of the lower part 401*b* of the main unit 401, wherein said strap loops 408 are configured to secure the main unit 401 to the strap 402. These strap loop may be attached directly to the lower part body 401*f*. The strap body 402*a* of the strap 402 may be threaded through or otherwise travel through each strap loop 408 to secure the strap 402 to the main unit 401.

Alternatively, strap through holes 410 disposed on opposite terminal ends 411-1 of the upper part 401*a* or opposite terminal ends 411-2 of the lower part 401*b* may be utilized to secure the main unit 401 to the strap 402. These strap through holes 410 may be placed adjacently to the securing cavities 405*a*, as seen in FIG. 4B. A strap 402 may travel through each corresponding strap through hole 410 in order to secure the strap 402 to the main unit 401. Said strap 402 of FIG. 4B may utilize a Velcro loop portion 411 on the head end 402*b* of the strap 402 and a Velcro hook portion (not shown) on the tail end 402*c* of the strap 402 in order to secure the tail end 402*c* and head end 402*b* of the strap 402 together to attach the formed wearable tissue receptacle to a user. Alternatively, the strap 402 may only travel through the strap through holes 410 on one of the parts of the main unit, such as only the strap through holes 410 of the lower part 402*b*, such that the upper part 401*a* may still be disengaged from the lower part 401*b* while the wearable tissue receptacle is being worn by a user, to allow for easy tissue replacement while the user is still wearing it. Comparable loop-hook fasteners, or other fastening methods, may be utilized by the strap 402 in order to secure the main unit 401 to the strap 402 and the strap 402 to a user. By providing the main unit 401 and the strap 402 as separable components of the wearable tissue receptacle, the main unit 401 and strap 402 may be used interchangeably with different straps 402 and main units 401 to allow a user to customize the functionality and appearance of their wearable tissue receptacle at will.

Figures 5A, 5B:
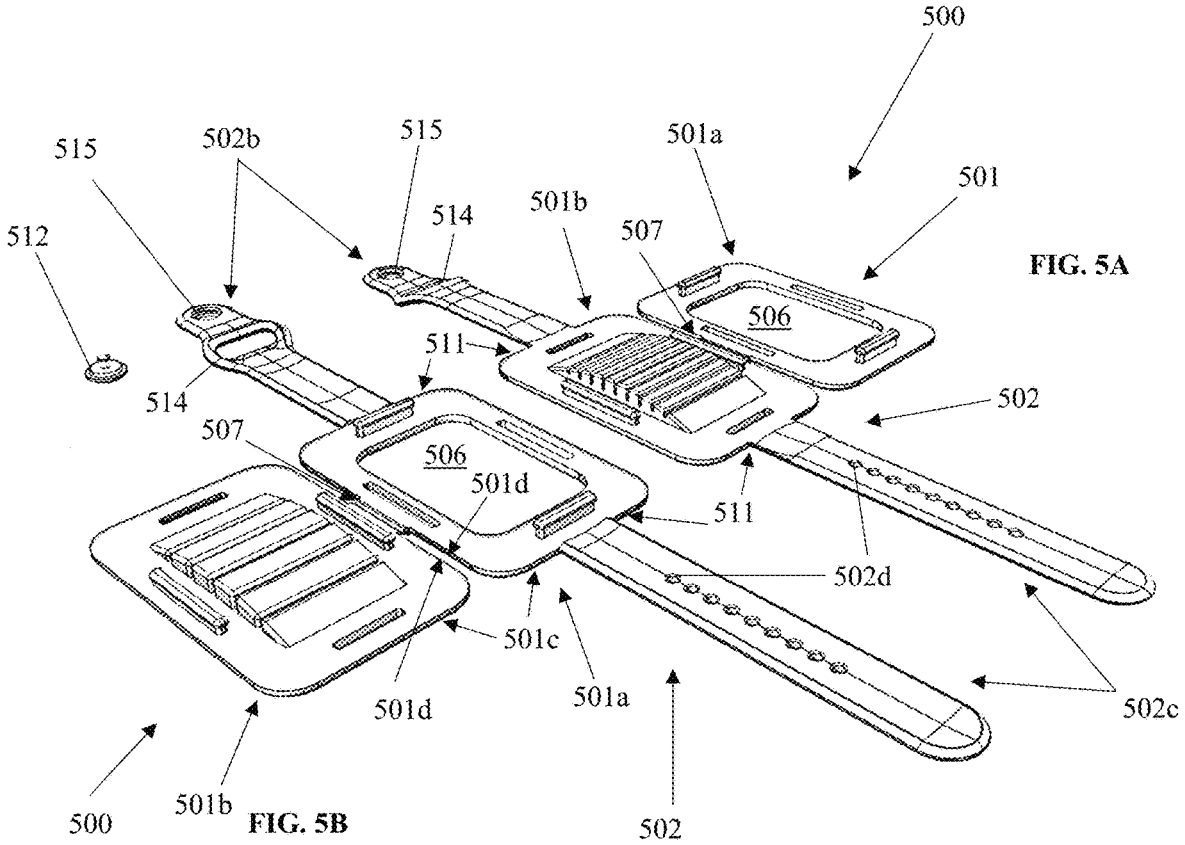
FIG. 5A illustrates the top perspective view of a strap directly secured to the lower part of the main unit, according to an aspect.
FIG. 5B illustrates the top perspective view of a strap directly secured to the upper part of the main unit, according to an aspect.

FIG. 5A illustrates the top perspective view of a strap 502 directly secured to the lower part 501*b* of the main unit 501, according to an aspect. FIG. 5B illustrates the top perspective view of a strap 502 directly secured to the upper part 501*a* of the main unit 501, according to an aspect. Unlike the wearable tissue receptacle assemblies described in FIG. 4A-4B, the strap 502 and the main unit 501 of the wearable tissue receptacle 500 of FIGS. 5A-5B may be combined into a singular monolithic structure. The strap 502 may be integrated into either the upper part 501*a* of the main unit 501, as seen in FIG. 5B, or the lower part 501*b* of the main unit 501, as seen in FIG. 5A. It may be preferred to integrate the main strap 502 into the structure of the lower part 501*b* main unit 501 as seen in FIG. 5A, as the positioning of a secured tissue bundle on the lower part 501*b* would allow the lower part 501*b* and a tissue bundle seated on the lower part 501*b* to be supported by the user's arm or wrist while the main unit 501 is open, making it easier to add/remove tissue bundles as needed. Additionally, the configuration of FIG. 5A may have the additional benefit of allowing tissue bundles to be secured within the wearable tissue receptacle 500 to be replaced without removing said receptacle from the user. As can be seen, the separate ends of the strap (e.g., the head end 502*b* and the tail end 502*c*) may be attached to corresponding terminal ends 511 of the corresponding main unit part. As seen in FIG. 5A, the head end 502*b* may be secured to a terminal end 511 of the lower part 501*b*, while the tail end 502*c* may be secured to the opposite terminal end 511 of the lower part 501*b*.

As discussed previously, a strap 502 may employ various methods of attachment to secure itself to a user's wrist or arm. One such method, referred to as a rivet fastener 512 method, may utilize a rivet fastener 512 to engage with a corresponding fastening through hole 502*d* of the plurality of fastening through holes 502*d* disposed on the tail end 502*c* of the strap 502. In order to secure the wearable tissue receptacle 500 of FIG. 5A-5B to a user, said user may insert the tail end 502*c* of the strap 502 through the end loop 514 on the head end 502*b* of the strap 502, such that the strap 502 wraps around the user's wrist or arm and the held outermost tissue, such as tissue bundle 203 of FIG. 2B is exposed to the user through the tissue window 506. Upon insertion of the tail end 502*c* through the end loop 514, a rivet fastener 512 may be inserted into a rivet port 515 in the head end 502*b* and one of the plurality of fastening through holes 502*d* in the tail end 502*c* in order to secure the head end 502*b* and the tail end 502*c* of the strap 502 together. Upon securing the head end 502*b* and tail end 502*c* of the strap together, the strap 502 may be reversibly secured to a user's wrist or arm and the wearable tissue receptacle may be ready for usage.

As can be seen in FIGS. 5A-5B, the securing hinge 507 may be suitably positioned between complementary edges of the main unit parts to facilitate the pivotal engagement of said parts as detailed hereinabove. As such, the securing hinge 507 may be disposed between complementary short ends 501*c* of the main unit parts, as seen by securing hinge 107 of main unit 101 in FIG. 1B, or disposed between complementary long ends 501*d* of the main unit 501 parts as seen by the securing hinge 507 of main unit 501 in FIGS. 5A-5B. As long as the securing hinge 507 facilitates the selective engagement of the upper part 501*a* and the lower part 501*b* of the main unit 501 as detailed herein, said securing hinge 507 may be disposed between any complementary portions of the upper part 501*a* and the lower part 501*b* of the main unit 501.

Figure 6A:
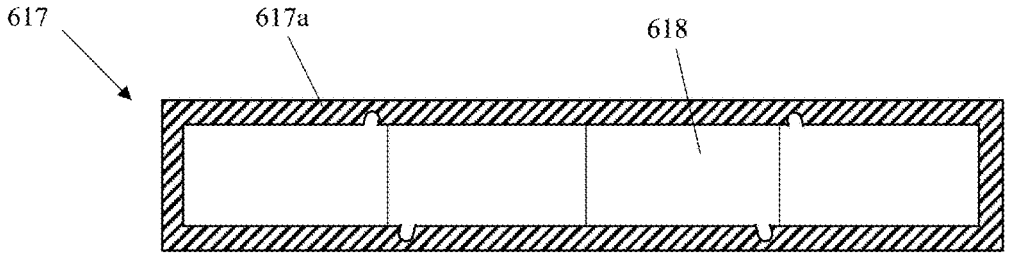
FIGS. 6A-6F illustrates the process of manufacturing a specialized tissue paper stack for use with the disclosed wearable tissue receptacle, according to an aspect.
Figure 6B:
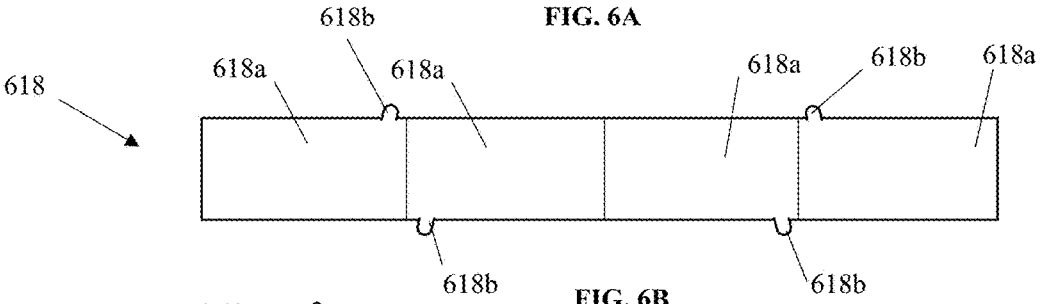
Figure 6C:
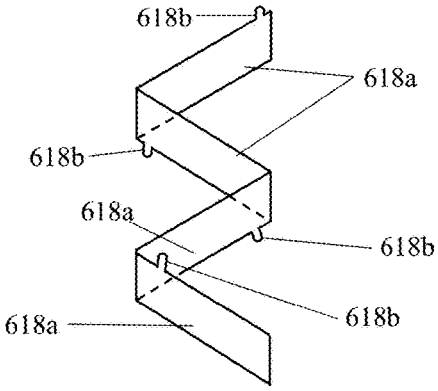
Figure 6D:
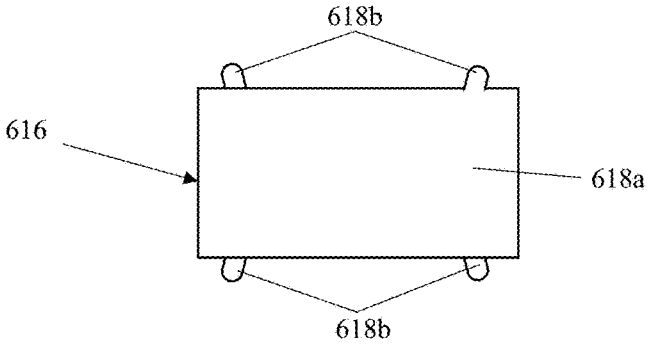

FIGS. 6A-6F illustrates the process of manufacturing a specialized tissue paper stack ("tissue stack") 616 for use with the disclosed wearable tissue receptacle, according to an aspect. While the disclosed wearable tissue receptacle may be configured to function properly even with standard tissues, a specialized tissue stack 616 may be utilized within said wearable tissue receptacle to fully utilize its complementary features. The process of producing a tissue stack 616 may begin with the cutting of a long sheet 617 of laminated paper as depicted in the top view of the long sheet 617 in FIG. 6A, wherein the hashed section 617*a* of the long sheet 617 is removed to produce a cropped sheet 618 having a plurality of suitably spaced and oriented grip tabs ("tissue tabs", "tab") 618*b*, as depicted in FIG. 6B. As shown in FIG. 6B, this cropped sheet 618 may be comprised of four tissue sections ("singular tissues", "tissue layers") 618*a*, each tissue section 618*a* being associated with a correspondingly positioned grip tab 618*b* for suitable manipulation of the respective tissue section 618*a* on the formed tissue stack 616. The size and quantity of tissue sections may be varied based on the desired characteristics of the formed tissue stack 616. Next, the cropped sheet 618 may be folded, as depicted in FIG. 6C, such that each section 618*a* section is suitably stacked together into a singular tissue stack 616, as seen in FIG. 6D.

Figure 6E:
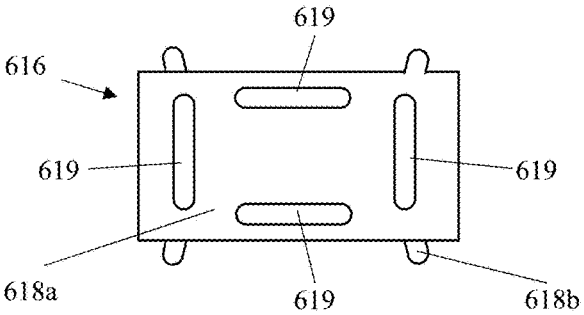

Upon being folded into a tissue stack 616, cutout through holes ("cutouts", "cut-outs") 619 may be punched through the tissue stack 616, as seen in FIG. 6E, such that each tissue section 618*a* has a corresponding quantity of cutouts 619. These cutouts 619 are configured such that the tissue stack 616 does not impede the engagement and disengagement of the upper part and lower part of the main unit. Each cutout 619 is configured to allow a corresponding securing ridge, such as securing ridge 205*b* of FIG. 2A, to travel through (e.g., be partially nested within) said cutout 619 before engaging with its corresponding securing cavity. This functionality of each cutout 619 to not only prevent the held tissue stack 616 from interfering with the functionality of the main unit, but also surround and engage with a corresponding securing ridge, allows the tissue stack 616 to remain securely seated within the main unit, even when the upper part and lower part of the main unit are not fully engaged (e.g., the main unit 201 is open as depicted in FIG. 2A or the main unit is partially opened as depicted in FIG. 2B.)

Figure 6F:
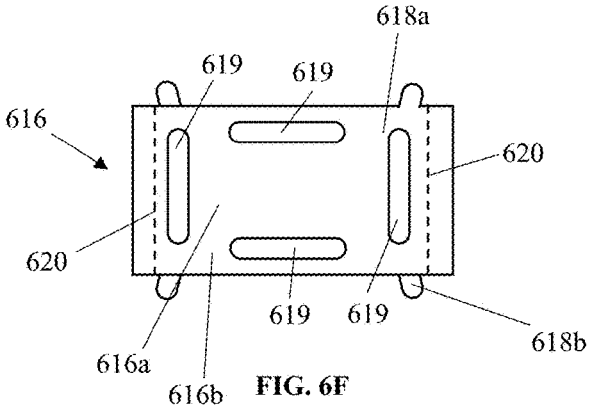

Finally, the formed tissue stack 616 may be perforated to allow for easy removal of each tissue section at will, as seen by the perforations 620 in FIG. 6F. These perforations 620 may be aligned with a release hinge on the upper part, such as release hinge 209 of FIG. 2B, such that an outermost tissue section 618*a* may be removed from the tissue stack 616 by tearing said tissue section 618*a* along its corresponding perforations 620, exposing a clean, unused tissue section for use. By aligning the perforations 620 with the edge of the aforementioned mounted portion of the upper part, such as mounted portion 232*a* of FIG. 2B, a suitable amount of tension may be applied to mounted part of the tissue stack to further prevent tissue stack movement while tearing along said perforation 620.

The user may remove a tissue section 618*a* from the tissue stack 616 by pulling said tissue section 618*a* by a corresponding attached grip tab 618*b*. The grip tab 618*b* of each tissue section 618*a* may be not directly exposed to the user during wiping, and thus said grip tab 618*b* may remain free of potential contaminants, allowing the user to keep their hands clean while removing soiled tissue sections 618*a*. Upon partially opening the main unit using the release hinge 209 depicted in FIG. 2B, a corresponding grip tab 618*b* secured to the outermost tissue section 618*a* may be exposed for easy and sanitary removal of the outermost, soiled tissue section 618*a*.

The formed tissue stack 616 may have a rectangular shape when the tissue stack 616 is viewed from a top perspective, as seen in FIG. 6D-6F. Each grip tab 618*b* may be positioned at a different corner portion of this rectangular shape, such that each grip tab 618*b* is sufficiently distant from the other grip tabs 618*b* to ensure a user may grab one grip tab 618*b* at a time. This pattern of grip tabs may be modified as necessary to accommodate greater quantities of tissue sections 618*a* in a tissue stack 616, such that each grip tab 618*b* is visible and distinct from the other grip tabs 618*b*.

When the last tissue section 618*a* held within a tissue stack 616, tissue cartridge or other type of tissue bundle is soiled and/or removed, the tissue bundle may be identified as depleted. As such the depleted tissue bundle (depleted tissue stack/depleted tissue cartridge/etc.) may be removed from the wearable tissue receptacle and subsequently replaced to facilitate continued usage. First, the main unit may be fully opened as depicted in FIG. 2A. Next a final, soiled tissue section 618*a*, as well as any attached residual elements of the tissue stack may be removed from the main unit by grabbing and removing said final tissue section by its unsoiled grip tab 618*b*. Next, a new tissue or tissue stack 616 may be placed on the lower part of the main unit, such that securing ridges of the lower part of the main unit are inserted through corresponding cutouts 619 in the tissue stack 616. At this point a central portion 616*a* of the tissue stack 616 should be seated upon the ribbed bridge, such as ribbed bridge 204 of FIG. 2A on the lower part 201*b*. Then the upper part 201*a* of the main unit may be engaged with the lower part 201*b* of the main unit 201, as described hereinabove in FIG. 2A. Each securing ridge 205*b* on the upper part 201*a* and lower part 201*b* of the main unit 201 may travel through a corresponding cut-out 619 in the tissue stack to help secure the tissue stack within the main unit. At this point, a perimeter portion 616*b* of the tissue stack 616 may be sandwiched between the upper part body and the lower part body, such as upper part body 101*e* and lower part body 101*f* of FIG. 1B, while a central part 616*a* of the tissue stack 616 may be seated on the ribbed bridge, such as ribbed bridge 104 of FIG. 1B, and protrude out of the tissue window, such as tissue window 106 of FIG. 1B. Upon engagement of the upper part and lower part, the wearable tissue receptacle will be ready for use, wherein the user may wipe their nose or face on the protruding, central portion 616*a* of the tissue stack 616.

The process of utilizing this wearable tissue receptacle may allow a user to remain clean while conveniently wiping their nose or face. First, a user may wipe their nose or face on a central portion 616*a* of a tissue stack 616 that is protruding out of the tissue window on the main unit. The user may repeat this wiping process until the outermost tissue section of the tissue stack is soiled. Next, the user may partially open the upper part of the main unit using the release hinge, such as release hinge 209 of FIG. 2B, as depicted in FIG. 2B. Then the user may grab a corresponding grip tab 618*b* attached to the outermost, soiled tissue section 618*a*, and pull said grip tab 618*b* until the soiled tissue section is removed from the tissue stack 616 by tearing along the corresponding perforation. Removal of this soiled tissue section may reveal a clean tissue section beneath it. After removal and disposal of the soiled tissue section 618*a* and exposure of a clean tissue section, the upper part may be fully reengaged with the lower part through re-insertion of any disengaged securing ridges through their corresponding cutout 619 in the tissue stack 616 and their corresponding securing cavity. The user may continue this process until the last tissue section 618*a* of a tissue stack 616 is soiled, at which point they may follow the tissue emptying and restocking process outline hereinabove. It should be understood that users below a certain age (e.g., young children) or other parties that may struggle to perform certain steps of the herein described processes may be assisted by a "supervisory user", wherein the supervisory user would perform said steps for the user as needed.

Figure 7:
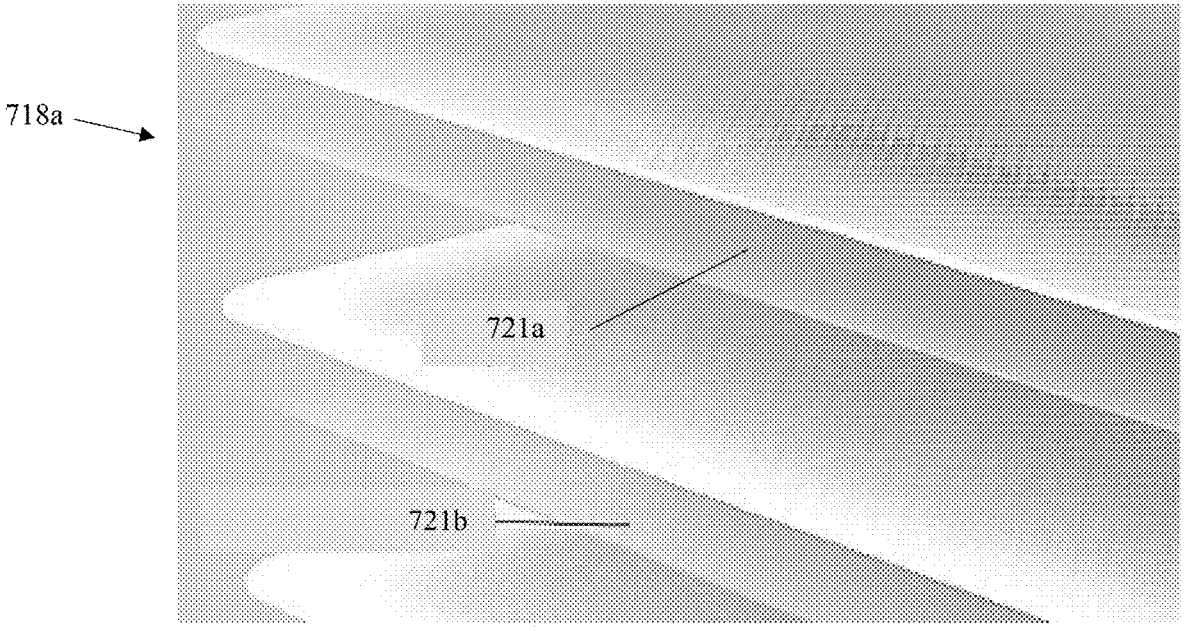
FIG. 7 illustrates the exploded view of a specialized tissue section for use with the disclosed wearable tissue receptacle, according to an aspect.

FIG. 7 illustrates the exploded view of a specialized tissue section 718*a* for use with the disclosed wearable tissue receptacle, according to an aspect. A specialized tissue for use with the disclosed tissue receptacle, such as wearable tissue receptacle 500 of FIG. 5A, may be comprised of tissue sections 718*a* having a paper layer 721*a* and a polyethylene (PE) layer 721*b* which can be laminated together. The PE layer 721*b* may be configured to prevent proliferation of moisture from an upper tissue layer to a lower tissue layer. By preventing moisture leakage between tissue layers, the longevity of the corresponding tissue stack may be maintained, even in the presence of a soiled tissue section/layer above one or more clean tissue layers. As such, the PE layer 721*b* attached to each paper layer 721*a* may be configured to separate its attached paper layer 721*a* from an adjacent tissue section (e.g., a PE layer 721*b* may be laminated to the top and/or bottom surface(s) of the paper layer 721*a*) to suitably prevent any moisture trapped within a corresponding tissue section 718*a* from quickly seeping into adjacent tissue sections. If the PE layer 721*b* is configured to coat the bottom of the paper layer 721*a*, then pulling the paper layer 721*a* will also pull out the PE layer 721*b*, thus removing the need to explicitly pull out or discard the PE layer 721*b* individually. It should be understood that while the tissue stack, such as tissue stack 616 shown in FIG. 6F, may be comprised of four tissue sections 618*a*, the quantity and size of the tissue sections 618*a* used to form a tissue stack 616 may be optimized as necessary to, for example, reduce the frequency with which the tissue stack must be replaced.

In order to use standard tissues with this wearable tissue receptacle, a user may obtain one or more standard tissues, fold them individually into the proper size, stack them accordingly, place the formed standard tissue stack on the lower part of the main unit, and engage the upper part and lower part such the securing ridges punch through the standard tissue stack. The ability of this standard tissue stack to perform accordingly is based on the characteristics of the standard tissues used. For example, a standard tissue stack made of standard tissues without a suitable non-permeable layer, such as the hereinabove PE layer or a polyurethane layer, may allow moisture to seep into other standard tissue within the standard tissue stack prior to their usage, thus increasing tissue usage. For the best results, the herein disclosed tissue stack 616 of FIG. 6F, the tissue cartridge 822 of FIG. 8A, or another suitably leakage proof tissue arrangement may be utilized as the tissue bundle within the wearable tissue receptacle.

In a preferred embodiment, the specialized tissue stack may use tissue paper comprised of 65% viscose and 35% polyester, said tissue paper being semi-crosslap with an areal density ("grammage") of 72 GSM. Other types of paper having different compositions and characteristics may be used as well, depending on the application of said specialized tissue, as long as these types of paper have smooth wiping surface to prevent discomfort while wiping and a suitably high tensile strength to prevent undesired ripping during usage. A tissue stack made to the specifications described hereinabove, having all of the features described for the tissue stack 616 described in FIGS. 6A-6F, may provide an ideal wiping surface for the hereinabove disclosed wearable tissue receptacle. While the hereinabove described wearable tissue receptacle may function properly using standard tissues, by providing a functional wearable tissue receptacle configured to hold specially configured tissue stacks or cartridges, a user may be provided with an easy to utilize solution for wiping their nose or face that is comfortable to wear and use, as well as easy to restock and maintain.

Figure 8B:
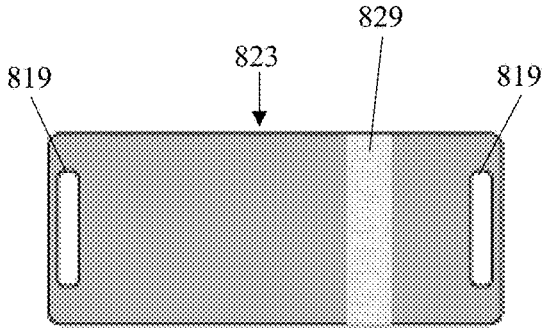
FIGS. 8B-8G illustrate the top views of the various tissue layers of a tissue cartridge, according to an aspect.
Figure 8C:
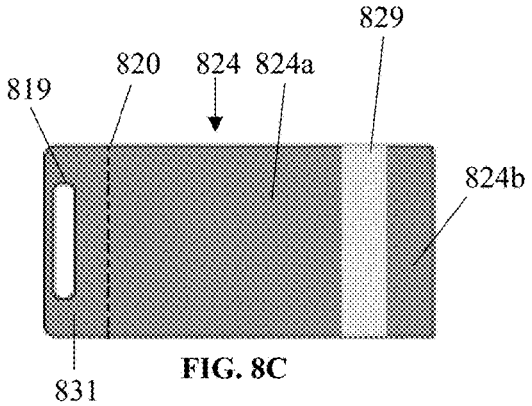
Figure 8D:
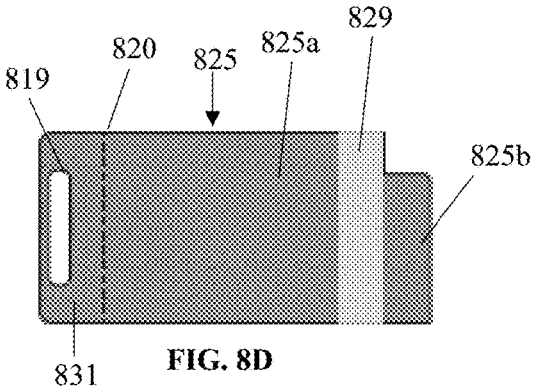
Figure 8E:
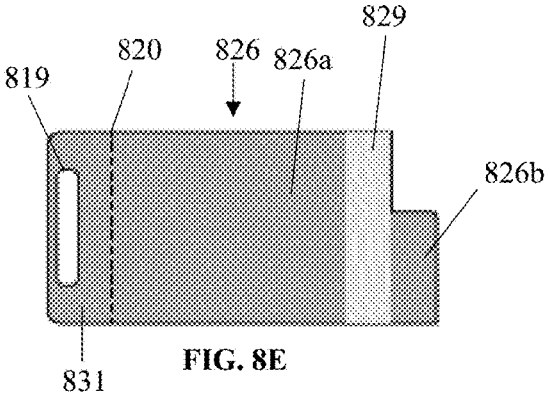
Figure 8F:
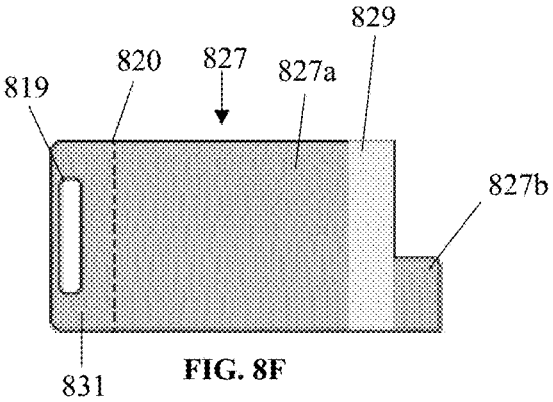
Figure 8G:
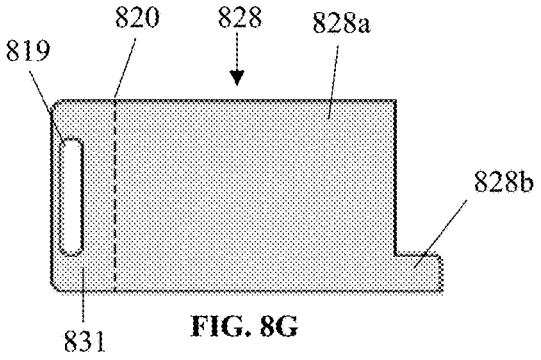

FIG. 8A illustrates the top view of a tissue cartridge 822, according to an aspect. FIGS. 8B-8G illustrate the top views of the various tissue layers of a tissue cartridge 822, according to an aspect. An alternative tissue arrangement that may be utilized with the herein disclosed wearable tissue receptacle is a tissue cartridge 822. Similarly to the hereinabove described tissue stack 616 of FIG. 6F, said tissue cartridge 822 may be comprised of a plurality of stacked, separable tissue sections/layers, each tissue section/layer having a corresponding grip tab. As seen in FIG. 8B-8G, the tissue cartridge 822 may be comprised of 6 separate layers, including a base layer 823 as seen in FIG. 8B, a first tissue layer 824 having a first tissue body 824*a* attached to a first tissue tab 824*b*, as seen in FIG. 8C, a second tissue layer 825 having a second tissue body 825*a* attached to a second tissue tab 825*b*, as seen in FIG. 8D, a third tissue layer 826 having a third tissue body 826*a* attached to a third tissue tab 826*b*, as seen in FIG. 8E, a fourth tissue layer 827 having a fourth tissue body 827*a* attached to a fourth tissue tab 827*b*, as seen in FIG. 8F and a fifth tissue layer 828 having a fifth tissue body 828*a* attached to a fifth tissue tab 828*b*, as seen in FIG. 8G. Each of these layers may be stacked within the tissue cartridge 822, starting with the base layer 823 on the bottom, followed by the first tissue layer 824, then the second tissue layer 825 and so on. The base layer 823 may be made of a material that is harder than the attached tissues layers, while still being flexible to follow the curve of the below ribbed bridge, such 90 GSM paper.

Each tissue layer may be further comprised of perforations 820 in the corresponding tissue body, such that each tissue layer may be easily and selectively torn off of the tissue cartridge 822. Every layer, with the exception of the fifth tissue layer 828, may be further comprised of an adhesive portion 829 configured to adhere to a layer above it, such that the adhesive portion 829 on the base layer 823 adheres the base later 823 to the first tissue layer 824, the adhesive portion 829 on the first tissue layer 824 adheres the first tissue layer to the second tissue layer 825, and so on. The fifth tissue layer 829 may omit the adhesive layer, due to it lacking a tissue layer disposed above it. These adhesive portions 829 may be made of a soft, easy to remove glue that helps keep the formed tissue cartridge 822 together while the user wipes their nose or face on the tissue body of the outermost tissue layer. Each tissue layer may be further comprised of a polyurethane (PU) coating to prevent proliferation of moisture between the tissue layers, similarly to the PE coating 721*b* on the tissue section 718*a* described in FIG. 7. Each tissue layer of the tissue cartridge 822 may have a PU coating on its bottom surface to prevent said proliferation to layers beneath it. For example, the PU coating on the third tissue layer 826 may prevent moisture within said third tissue layer 826 from seeping into the second tissue layer 825, thus preserving tissue stack longevity.

The base layer 823 may be further comprised two cutouts 819, wherein the insertion of securing ridges from the main unit into these two cutouts 819 on the base layer 823 helps keep the tissue cartridge 822 secured to the main unit. Each tissue layer (824-829) may be further comprised of a single cutout 619 configured to surround one of the securing ridges from the main unit, such as main unit 901 from FIG. 9. As a result of each tissue layer being secured to the main unit by its respective cutout 819, and the tissue cartridge 822 by an adjacent adhesive portion 829, each tissue layer may remain securely in place while be wiped on, but may be removed from the tissue cartridge 822 and the main unit by first holding the corresponding tissue tab (824*b*-828*b*) and simply peeling it off from the cartridge and then pulling the tissue layer away from the securing ridge 905*b* that it is secured to by tearing it off by its perforation 820. As can be seen by tissue cartridge 822 of FIG. 8A, the tissue tabs of each tissue layer may be sized and arranged to allow the for the selective removal of each tissue layer from the tissue stack, one at a time, while providing a visual indication of how may tissue layers are remaining in the main unit.

After tearing a tissue layer by its corresponding perforation 820, a waste portion 831 of the corresponding tissue layer may be left behind on the tissue cartridge 822. The waste portions 831 of each layer, including the base layer 823 may be fused together to reduce the thickness of the tissue cartridge at this section. The total thickness of these fused together waste portions 831 from all layers may be between 0.5-0.8 mm, but this value may differ depending on the specifications of materials used to make the base layer 823 and the tissue layers 824-829, as well as the quantity of tissue layers in the tissue cartridge 822. Each layer may also be a unique color in order to ease assembly and use, as the amount of remaining tissue may be readily recognized based on the color of the outermost tissue layer. For example, if the first tissue layer 824 has a yellow color, a user will be able to easily recognize when there is only one tissue layer left within the tissue cartridge 822 within the wearable tissue receptacle. Upon removal of all of all usable tissue bodies (e.g., a first tissue body 824*a*, the second tissue body 825*a*, etc.) from a tissue cartridge 822, the remainder of the tissue cartridge may be described as a depleted tissue cartridge or a depleted tissue bundle, as disclosed hereinabove, wherein the depleted tissue body is comprised on a plurality of waste portions 831, as was a base layer 823, if applicable.

Figure 9:
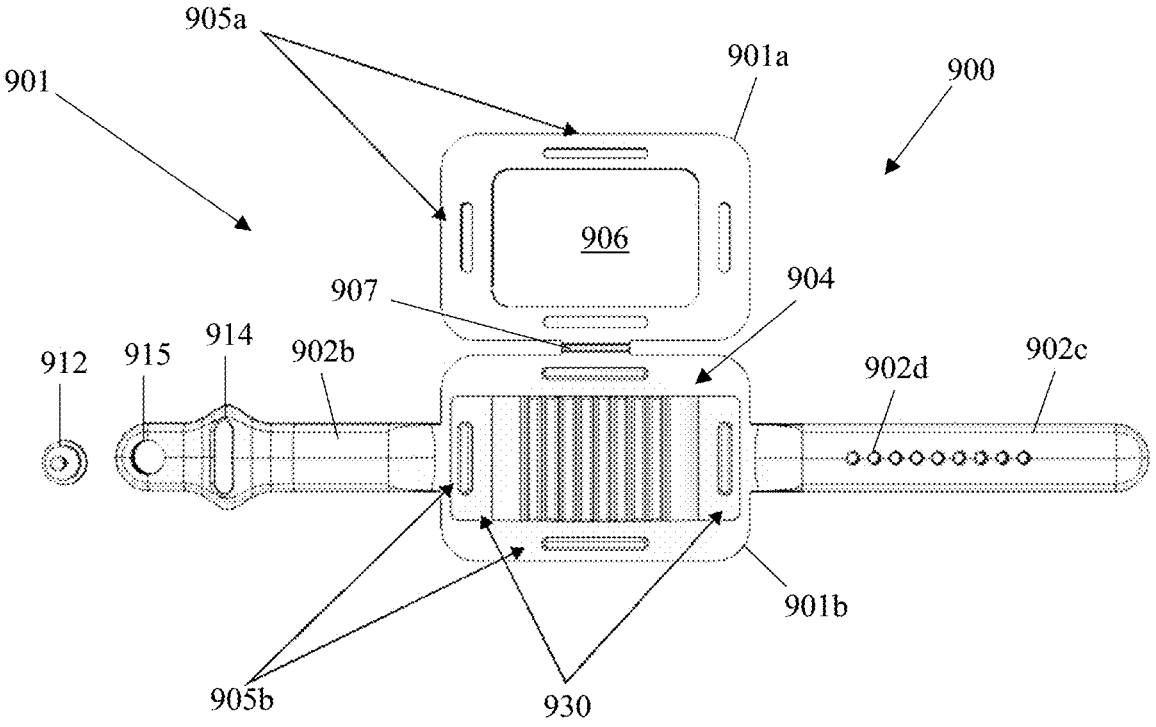
FIG. 9 illustrates the top view of a wearable tissue receptacle configured to engage with a tissue cartridge, according to an aspect.

FIG. 9 illustrates the top view of a wearable tissue receptacle 900 configured to engage with a tissue cartridge, according to an aspect. In order to suitably accommodate the usage of the hereinabove disclosed tissue cartridge, such as tissue cartridge 822 of FIG. 8A, a wearable tissue receptacle 900 may be further comprised of cartridge depressions 930 nested within the lower part 901*b* of the main unit 901. These cartridge depressions 930 may be configured to seat a tissue cartridge on the ribbed bridge 904 provided on the lower part 901*b* and help secure the tissue cartridge in place within the main unit. Both the cartridge depressions 930 and the securing ridges 905*b* are configured to properly align a tissue cartridge within the main unit 901, such that the tissue layers are seated on the ribbed bridge 904 such that they protrude through the tissue window 906.

The overall structure of the wearable tissue receptacle 900 of FIG. 9 may be similar to that of wearable tissue receptacle 500 of FIG. 5A. A tail end 902*c* of a strap and a head end 902*b* of a strap may be directly attached to the main unit 901, resulting in the main unit 901 and strap 902 of the wearable tissue receptacle 900 being a singular monolithic structure. Additionally, the wearable tissue receptacle 900 may utilize a rivet fastener 912 to secure the head end 902*b* and tail end 902 of the strap together, to secure the wearable tissue receptacle 900 to the user. Certain structural elements, including the end loop 914, fastening through holes 902*d*, tissue window 906 and the junction hinge 907 may be comparably configured and positioned between wearable tissue receptacles 900, 500 of FIG. 9 and FIG. 5A, accordingly.

As can be seen by the main unit 901 of FIG. 9, all of the securing ridges 905*b* may be attached to the lower part 901*b* and all of the securing cavities 905*a* may be disposed within the upper part 905*a*. By having all of the securing ridges 905*b* attached to the lower part 901*b*, or at least the securing ridges 905*b* that are configured to be inserted through the cutouts of the tissue cartridge seated on the lower part 901*b*, the installation of the tissue cartridge may be simplified by allow the securing ridges 905*b* and gravity to keep the tissue cartridge in place and seated on the ribbed bridge 904 while the upper part 901*a* is being engaged with the lower part 901*b*. With this configuration, the tissue cartridge may be easily replaced while the wearable tissue receptacle is still attached to the user's arm or wrist.

One notable benefit of using the disclosed tissue cartridge with the wearable tissue receptacle 900 of FIG. 9 is that a soiled tissue layer may be removed from the tissue cartridge without having to open or partially open the main unit 901. As a result of the positioning of each tissue tab within the tissue window 906, each tissue layer may be easily manipulated while the main unit is closed. So long as the user is careful to only wipe their nose or face on the tissue body of a corresponding tissue layer, while avoiding wiping on the grip tabs, the user may cleanly remove tissue layers from the tissue stacks through manipulation of the corresponding, unsoiled grip tab.

Figure 10A:
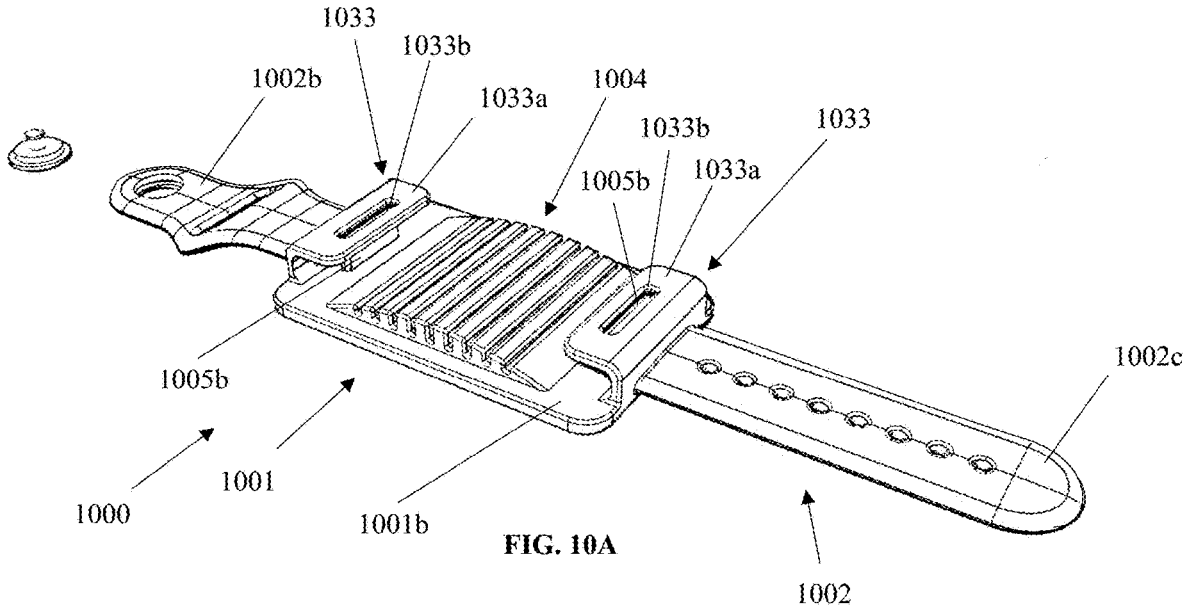
FIG. 10A illustrates the top perspective view of an alternative embodiment of a wearable tissue receptacle, according to an aspect.
Figure 10B:
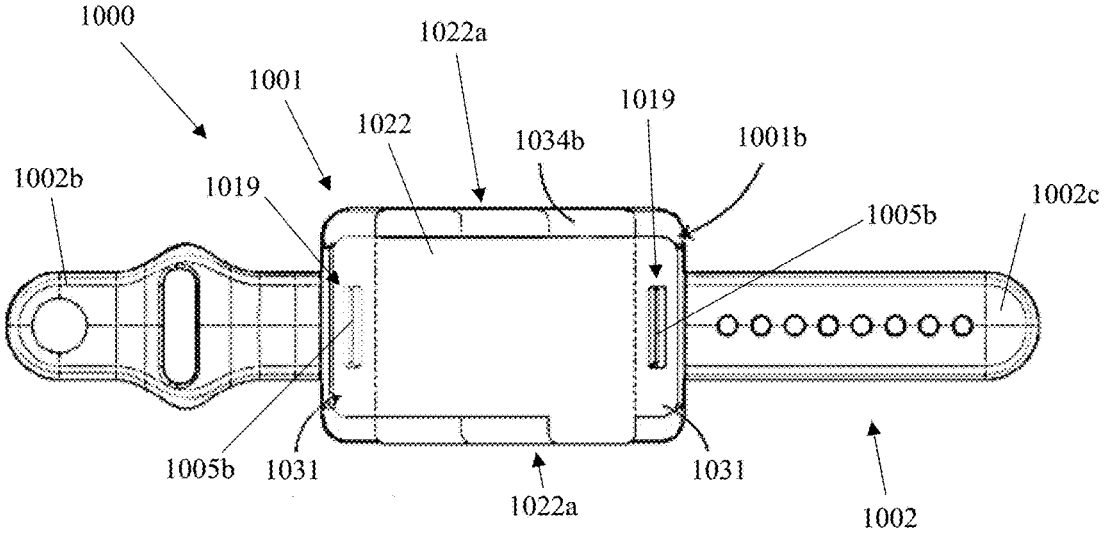
FIG. 10B illustrates the top view of an alternative embodiment of the wearable tissue receptacle engaged with an alternative embodiment of the tissue cartridge, according to an aspect.

FIG. 10A illustrates the top perspective view of an alternative embodiment of a wearable tissue receptacle 1000, according to an aspect. FIG. 10B illustrates the top view of an alternative embodiment of the wearable tissue receptacle 1000 engaged with an alternative embodiment of the tissue cartridge 1022, according to an aspect. Many features of the disclosed alternative embodiment of the wearable tissue receptacle 1000 of FIG. 10 may be the same of as its counterparts described hereinabove, with the exception of the mechanism utilized to secure the tissue cartridge 1022 to the wearable tissue receptacle 1000. In this alternative embodiment of the wearable tissue receptacle 1000, the tissue cartridge 1022 may be engaged with corresponding securing ridges 1005*b* disposed on the lower part 1001*b* of the main unit 1001, similarly to wearable tissue receptacle 900 of FIG. 9. The tissue cartridge 1022 may be configured to be seated on the lower part 1001*b* of the main unit 1001 such that its corresponding cutouts 1019 are each configured to surround a corresponding securing ridges 1005*b*, as described hereinabove.

One notable difference between the disclosed alternative embodiment of the wearable tissue receptacle 1000 of FIG. 10A and the embodiments disclosed hereinabove is the absence of an upper part of the main unit 1000 having a tissue window. The alternative embodiment of the wearable tissue receptacle 1000 instead utilizes a pair of protruding clasps 1033 to allow the main unit to engage securely with the tissue cartridge 1022 to maintain it in place. More specifically, each securing ridge 1005*b* on the lower part 1001*b* of the main unit 1000 may be configured to be inserted within a corresponding cutout 1019 of a tissue cartridge 1022, while each protruding clasp 1033 may be configured to engage with a corresponding securing ridge 1005, thus securing the tissue cartridge between the ribbed bridge 1004 and the protruding clasps 1033. Each protruding clasp 1033 may be comprised of a clasp body 1033*a* surrounding a securing cavity 1033*b*, wherein each securing ridge 1005*b* on the lower part 1001*b* is configured to travel through and be partially nested within the corresponding securing cavity 1033*b*. As such, an alternative embodiment of a tissue cartridge 1022 may be secured to the wearable tissue receptacle 1000 while leaving corresponding tissue tabs, such as first tissue tab 1034*b*, disposed on the lateral sides 1022*a* of the alternative tissue cartridge 1022. These tissue tabs may thusly be exposed to a user, making said tissue tabs easy for the user to grab. The alternative embodiments of the tissue cartridge 1022 will be discussed in greater detail hereinbelow.

The alternative embodiment of the wearable tissue receptacle 1022 may also omit the prior disclosed cartridge depression, such as cartridge depression 930 of FIG. 9, as the securing ridges 1005*b* and protruding clasps 1033 may prove to be sufficient to secure the tissue cartridge 1022 to the wearable tissue receptacle 1000. The protruding clasps 1033 may be made of the same material as the main unit 1001, such that the protruding clasps 1033 are rigid enough to prevent the tissue cartridge from unintentionally falling off the wearable tissue receptacle 1000, while allowing the user or an individual assisting the user to remove and or replace the tissue cartridge 1022 as necessary. As can be seen in FIG. 10, the wearable tissue receptacle 1000 may also only have two securing ridges 1005, both of which are configured to engage with the tissue cartridge 1022, wherein said securing ridges 1005*b* are configured to engage with corresponding protruding clasps 1033, due to the omission of said upper part in this alternative embodiment.

Aside from the differences described hereinabove, the alternative embodiment of the wearable tissue receptacle 1000 may otherwise be similar to embodiments disclosed hereinabove. For example, the alternative embodiment of the wearable tissue receptacle 1000 may be comprised of a main unit 1001 associated with a strap 1002, such that the main unit 1001 disposed between and attached to a head end 1002*b* and a tail end 1002*c* of the strap 1002. Furthermore, the strap 1002 and its various elements may be unchanged for this alternative embodiment of the wearable tissue receptacle 1000, wherein the only notable changes are made to the main unit 1001, with complementary modifications being made to the tissue cartridge 1022 itself.

Figure 11A:
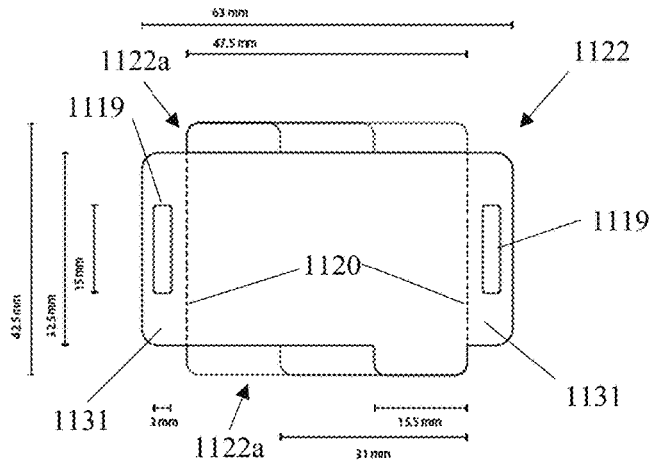
FIG. 11A illustrates the top view of an alternative embodiment of a tissue cartridge according to an aspect.
Figure 11B:
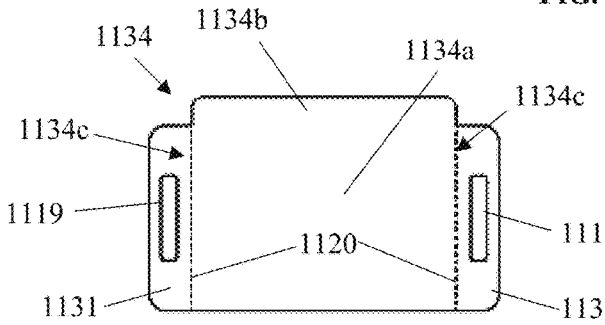
FIGS. 11B-11G illustrate the top views of the layers of an alternative tissue cartridge, according to an aspect.
Figure 11C:
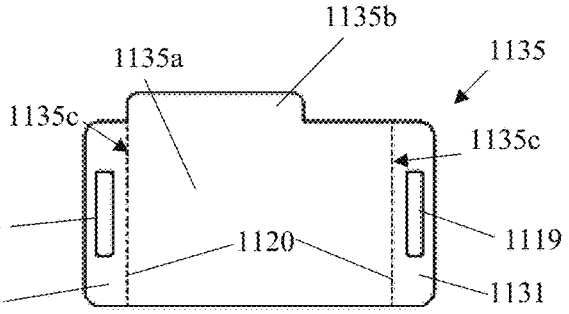
Figure 11D:
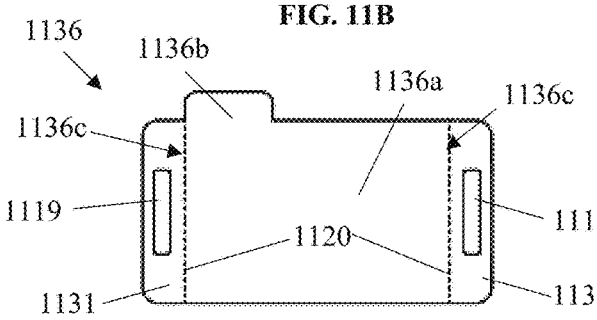
Figure 11E:
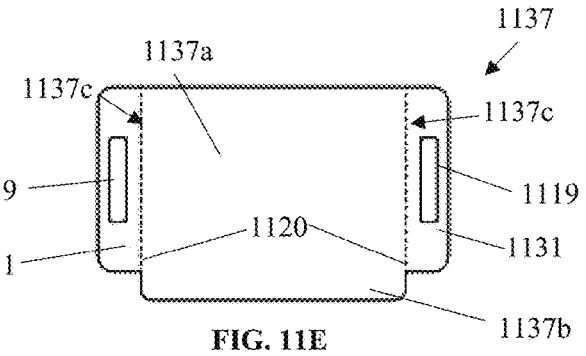
Figure 11F:
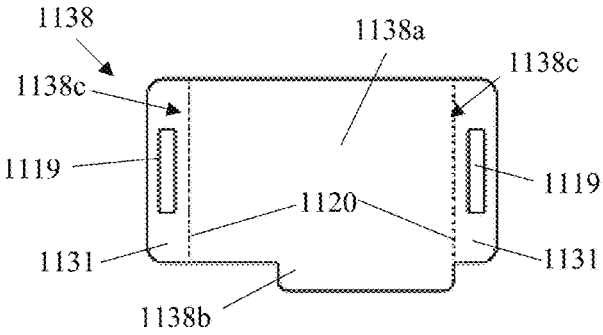
Figure 11G:
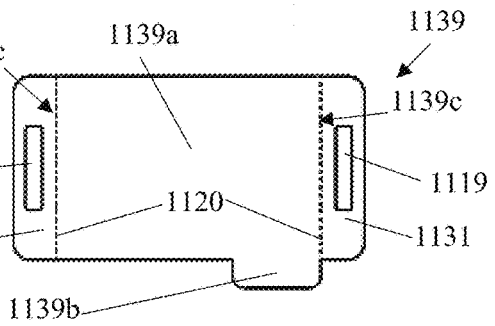

FIG. 11A illustrates the top view of an alternative embodiment of a tissue cartridge 1122 according to an aspect. FIGS. 11B-11G illustrate the top views of the tissue layers of an alternative tissue cartridge 1122, according to an aspect. As disclosed hereinabove, the alternative embodiment of the wearable tissue receptacle 1000 of FIG. 10 may be configured for use with an alternative tissue cartridge 1122. The alternative tissue cartridge 1122 may have six tissue layers, with each layer having a corresponding tab that is configured to be visually distinct and separately accessible from the other tabs, thus allowing a user to determine how many layers are left in a tissue cartridge upon visual inspection. As can be seen in FIG. 11B-11G, the alternative tissue cartridge may be comprised of a first tissue layer 1134 having a first tab 1134*b* associated with a first tissue body 1134*a*, a second tissue layer 1135 having a second tab 1135*b* associated with a second tissue body 1135*a*, a third tissue layer 1136 having a third tab 1136*b* associated with a third tissue body 1136*a*, a fourth tissue layer 1137 having a fourth tab 1137*b* associated with a fourth tissue body 1137*a*, a fifth tissue layer 1138 having a fifth tab 1138*b* associated with a fifth tissue body 1138*a* and a sixth tissue layer 1139 having a sixth tab 1139*b* associated with a sixth tissue body 1139*a*. The tissue cartridge may be constructed such that the sixth tissue layer 1139 is disposed above the fifth tissue layer 1138, the fifth tissue layer 1138 is disposed above the fourth tissue layer 1137, and so on. As such, the first tissue layer removed from an alternative tissue cartridge 1122 may be the sixth tissue layer 1139, followed by the fifth tissue layer 1138 and so on.

Each tissue body (e.g., the first tissue body 1134*a*, the second tissue body 1135*a*, the third tissue body, etc.,) may be further associated with a corresponding waste portion 1131 disposed on each distal end 1134*c*, 1135*c*, 1136*c*, 1137*c*, 1138*c*, 1139*c* of the corresponding tissue layer 1134, 1135, 1136, 1137, 1138, 1139. This association between each tissue body and its corresponding waste portions may again be done with a corresponding perforation 1120, such that each tissue body of each tissue layer may be removed from the tissue cartridge by pulling the corresponding tissue tab.

For example, by pulling on the sixth tissue tab 1139*b* of a tissue cartridge 1122, the sixth tissue body 1139*a* may be removed from the tissue cartridge 1122 by tearing the sixth tissue layer along the described perforations 1120, thus leaving its corresponding waste portions 1131 attached to the tissue cartridge 1122 while exposing the fifth tissue layer 1138 for use. Each waste portion 1131 of each tissue layer may have a cutout 1119 nested within it, such that the formed tissue cartridge 1121 may be engaged with corresponding securing ridges, such as securing ridges 1005*b* of FIG. 10A, to help secure each tissue layer, and thus the formed tissue cartridge 1122, to a wearable tissue receptacle.

Unlike the previous embodiments of tissue cartridges, the tissue tabs 1134*b*, 1135*b*, 1136*b*, 1137*b*, 1138*b*, 1139*b* may be disposed on the lateral sides 1122*a* of the tissue cartridge 1122. This positioning of the tissue tabs allows for the tissue tabs to be provided in a larger size than previous tissue cartridge embodiments, thus making said tissue tabs easier to grab. Additionally, every layer of this alternative embodiment of the tissue cartridge 1122 may have a usable tissue body for a user to engage with (e.g., wipe their nose or face on) rather than having an unusable base layer, such as base layer 823 of FIG. 8B. In the disclosed embodiment of the alternative wearable tissue receptacle, the alternative tissue cartridge 1122 may be configured to engage with the main unit sufficiently well that a rigid base layer is not necessary to support the tissue layers of the tissue cartridge 1122. Alternatively, certain embodiment of tissue cartridge 1122 may be provided with a rigid base layer disposed below the tissue layers (e.g., between the tissue layers and the arched bridge, such as ribbed bridge 1004 of FIG. 10A, depending on the needs of the application, integrity and composition of each tissue layer, quantity of tissue layers, etc., in order to support the tissue layers as needed. The usage of an adhesive portion, such as adhesive portion 829 of FIG. 8C, may not be necessary for the alternative tissue cartridge 1122 of FIG. 11, as each tissue layer is sufficiently secured to the tissue cartridge by its associated waste portions 1131 disposed on the distal ends 1134*c*-1139*c* of each tissue layer 1134-1139. This in turn may be configured to firmly secure each tissue layer to the tissue cartridge until said tissue layer is selectively removed by the user. As disclosed hereinabove, each tissue layer may have a paper layer and an impermeable or fluid resistant layer (e.g., PE, PU, etc.) which can be laminated together, to prevent leakage of fluids between tissue layers.

Figure 12A:
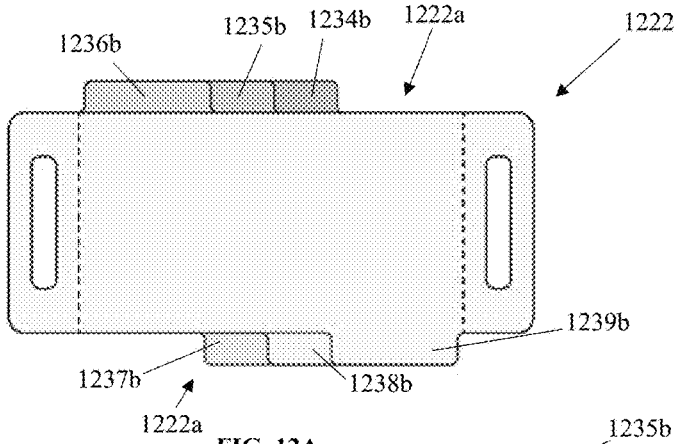
FIG. 12A illustrates the top view an alternative embodiment of the tissue cartridge 1222, according to an aspect.
Figure 12B:
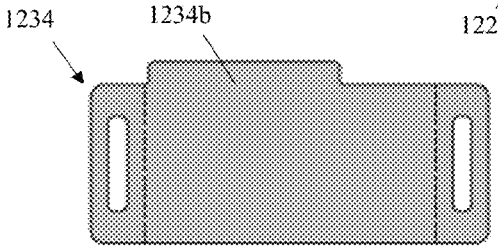
FIGS. 12B-12G illustrate the top views of the layers of an alternative tissue cartridge, according to an aspect.
Figure 12C:
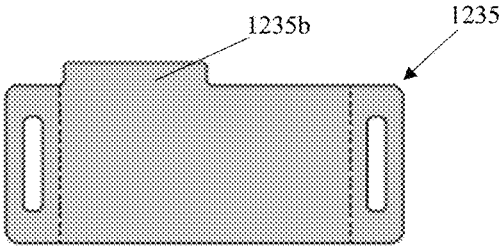
Figure 12D:
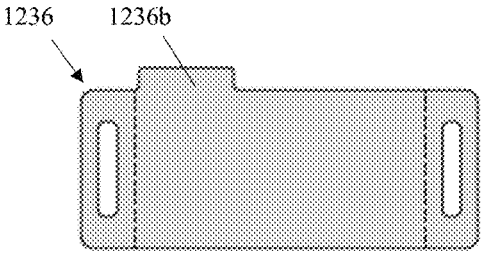
Figure 12E:
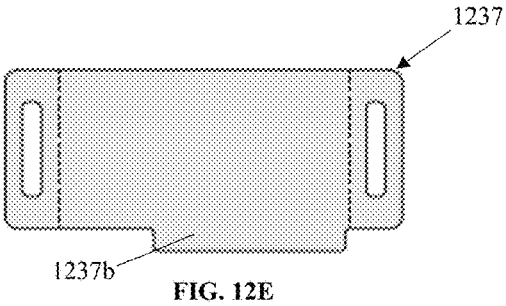
Figure 12F:
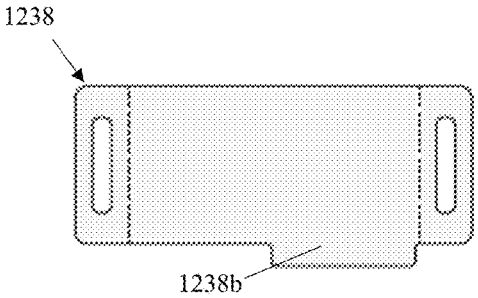
Figure 12G:
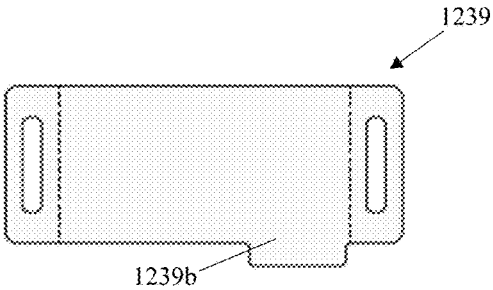

FIG. 12A illustrates the top view an alternative embodiment of the tissue cartridge 1222, according to an aspect. FIGS. 12B-12G illustrate the top views of the layers of an alternative tissue cartridge, according to an aspect. The disclosed alternative embodiment of tissue cartridge 1222 of FIG. 12A may be mostly similar to the previously disclosed alternative embodiment of tissue cartridge 1122 of FIG. 11A. The main difference between these alternative embodiments of the tissue cartridge being the size of the tissue tabs 1234*b*, 1235*b*, 1236*b*, 1237*b*, 1238*b*, 1239*b* of the presently disclosed alternative tissue cartridge 1222 of FIG. 12A are smaller than those of the previously disclosed alternative tissue cartridge 1122 of FIG. 11A. One notable side effect of this is that the tissue tabs 1234, 1235, 1236, 1237, 1238, 1239 of this alternative tissue cartridge 1222 may be somewhat more difficult to manipulate due to their smaller size, but may be less likely to be wiped on by accident and utilize less material. The tissue tabs may again be disposed on the lateral sides 1222*a* of the tissue cartridge 1222, such that the tissue tabs may be easily accessed by the individual wearing the corresponding wearable tissue receptacle without being blocked by the disclosed protruding clasps, such as protruding clasps 1033 of FIG. 10A.

As described hereinabove, aside from the differences in the sizes and positions of the tissue tabs, the alternative tissue cartridges 1122, 1222 of FIG. 11 and FIG. 12, respectively, may be largely the same. The alternative tissue cartridge 1222 may be comprised of six tissue layers: a first tissue layer 1234, a second tissue layer 1235, a third tissue layer 1236, a fourth tissue layer 1237, a fifth tissue layer 1238 and a sixth tissue layer 1239, wherein each tissue layer has a corresponding tissue tab configured to be visible and accessible to the user. It should be understood that the quantity of tissue layers in a tissue cartridge 1222 may be suitably modified depending on the desired longevity of the tissue cartridge 1222, the type of tissue material used, the presence of impermeable layers, etc. It should also be understood that modifications to the size and position of each tissue tab may be made as needed, as long as an attached user may still easily access and manipulate said tissue tab. It may also be preferable to maintain the arrangement of tissue tabs in such a way that a user can quickly determine how many tissue layers are left in a tissue cartridge, by having each tissue tab be visible regardless of how many tissue layers are left in a tissue cartridge 1222.

Figure 13:
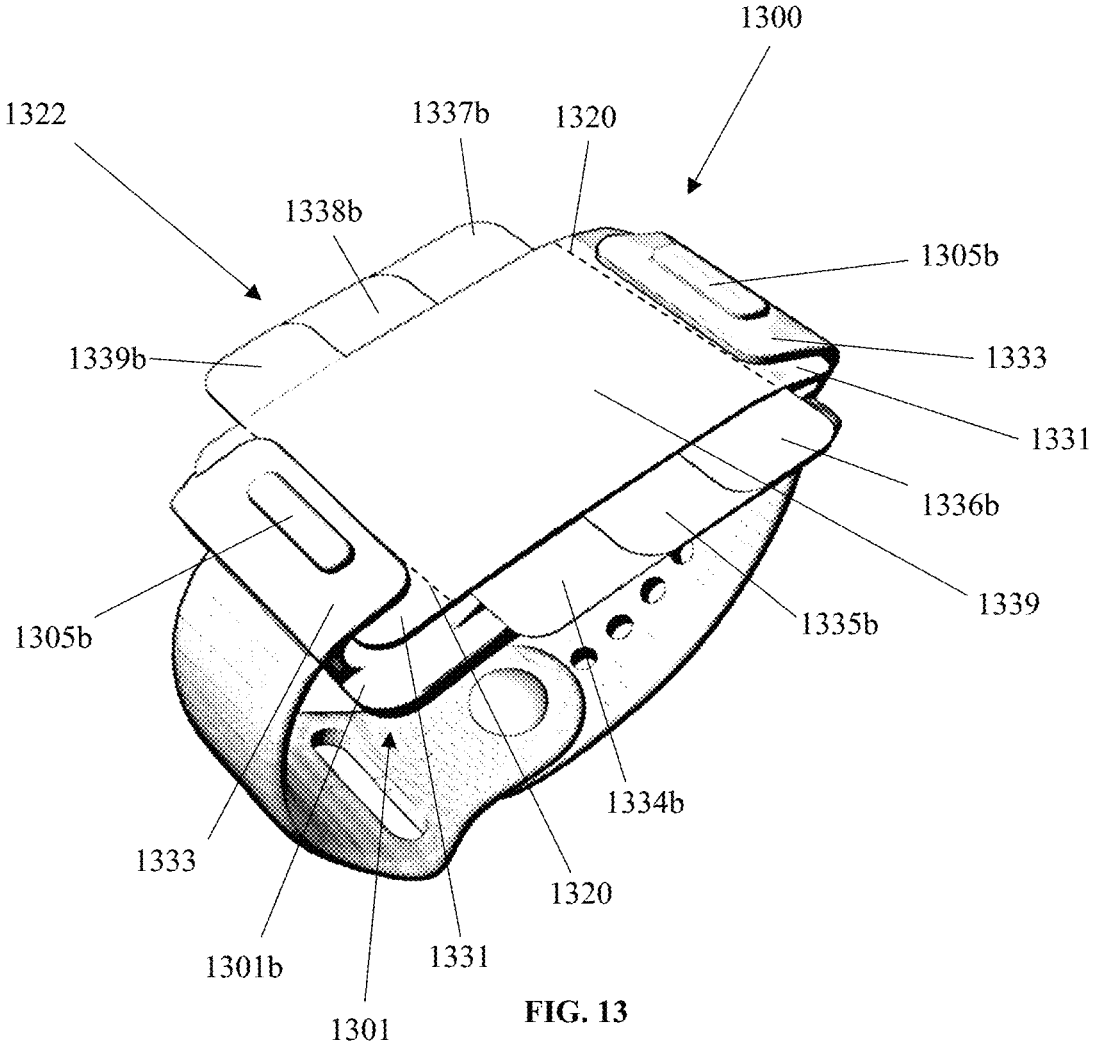
FIG. 13 illustrates the top perspective view of an alternative embodiment of the wearable tissue receptacle, according to an aspect.

FIG. 13 illustrates the top perspective view of an alternative embodiment of the wearable tissue receptacle 1300, according to an aspect. As disclosed hereinabove, the alternative embodiment of the wearable tissue receptacle 1300 may be configured to securely engage with an alternative embodiment of the tissue cartridge 1322. Each securing ridge 1305*b* disposed on the main body 1301 may be configured to be nested within a pair of corresponding cutouts, such as cutouts 1119 of FIG. 11A, nested within the tissue cartridge 1322. Each securing ridge 1305*b* may also be configured to engage with a corresponding securing cavity nested within a corresponding protruding clasp 1333, such as securing cavity 1033*b* of FIG. 10A, such that the waste portions 1331 of the tissue cartridge 1322 are each compressed between the lower part 1301*b* of the main body 1301 and the corresponding protruding clasp 1333, thus locking the tissue cartridge 1322 securely in place on the main unit 1301. Once the tissue cartridge has been depleted (e.g., all of the tissue layers have been removed from the tissue cartridge 1322), the waste portions 1331 may be removed by disengaging the protruding clasps 1333 from their corresponding securing ridges and sliding the waste portion 1331 off of the securing ridge for disposal.

In this alternative embodiment of the wearable tissue receptacle 1300, each of the tissue tabs 1334*b*, 1335*b*, 1336*b*, 1337*b*, 1338*b*, 1339*b* may be easily accessed and grip by a user, while leaving the remainder of the tissue cartridge in place. This in turn allows a user or individual assisting the user to tear a tissue layer 1339 off of the tissue cartridge 1333 by gripping the corresponding, unsoiled tissue tab 1339*b* and tearing the tissue layer 1339 about its corresponding perforations 1320. This alternative embodiment may securely engage with the tissue cartridge 1322 and allow for removal of each tissue layer 1339*b* about its corresponding tissue tab 1339*b* without having to interface with the protruding clasps 1333/securing ridges 1305*b* until the tissue cartridge is depleted. While removing a specific tissue layer from the tissue cartridge 1322, the remainder of the tissue layers may be configured to remain securely affixed to the tissue cartridge 1322, and thus the wearable tissue receptacle 1300. As such, a user may find this alternative embodiment of the wearable tissue receptacle 1300 and its corresponding tissue cartridge 1322 preferable due to its ease of use. Furthermore, as disclosed hereinabove, the wearable tissue receptacle may be comprised of a sturdy, but flexible material, such as silicone, that would allow for a user to easily manipulate the protruding clasps 1333 as necessary to selectively engage them with the securing ridges 1305*b* without requiring undue force or effort.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. As used in this application, "and/or" means that the listed items are alternatives, but the alternatives also include any combination of the listed items.

The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. The terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases.

Throughout this description, the aspects, embodiments or examples shown should be considered as exemplars, rather than limitations on the apparatus or procedures disclosed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples.

What is claimed is:

1. A wearable tissue receptacle comprising:
a main unit having:
a lower part; and
a ribbed bridge disposed on the lower part, the ribbed bridge having two end portions and a middle portion disposed between the two end portions,
the ribbed bridge comprising a plurality of ribs, wherein ribs disposed at the end portions of the ribbed bridge are shorter than ribs disposed at the middle portion of the ribbed bridge, such that the ribbed bridge forms a rounded arch;
a strap configured to be attached to the main unit, wherein the strap is configured to secure the main unit to a user;
a tissue bundle configured to be engaged with the main unit, the tissue bundle having:
at least one tissue layer comprising:
a tissue body portion;
a waste portion associated with the tissue body portion;
a tissue tab associated with the tissue body portion, the tissue tab being configured to be manipulated by the user to separate the tissue body portion from the waste portion;
wherein the tissue bundle is configured to be seated on the ribbed bridge; and
a securing ridge disposed on the main unit and a securing cavity disposed on the main unit, wherein the securing ridge is configured to be selectively, partially nested within the securing cavity to secure the tissue bundle to the main unit.

2. The wearable tissue receptacle of claim 1, further comprising a cutout nested within the tissue bundle, wherein the securing ridge is configured to be partially nested within the cutout to secure the tissue bundle to the main unit.

3. The main unit of claim 1, further comprising an upper part having a tissue window, wherein the upper part is pivotally engaged with the lower part, and the upper part is configured to be selectively engaged with the lower part by nesting the securing ridge within the securing cavity, such that the ribbed bridge and tissue bundle protrude through the tissue window.

4. The upper part of claim 3, further comprising a mounted portion pivotally engaged with the lower part and a rotating portion pivotally engaged with the mounted portion; wherein the mounted portion is configured to be selectively engaged with the lower part, and the rotating portion is configured to be selectively engaged with the lower part while the mounted portion is engaged with the lower part.

5. The main unit of claim 1, further comprising a protruding clasp associated with the lower part, wherein the securing cavity is nested within the protruding clasp, such that the protruding clasp is configured to engage with the securing ridge to secure the tissue bundle to the main unit.

6. The tissue bundle of claim 1, wherein each tissue layer is made of 65% viscose and 35% polyester and has an areal density of 72 GSM.

7. The tissue bundle of claim 1, wherein each tissue tab of each tissue layer is disposed on a lateral side of the tissue bundle.

8. The wearable tissue receptacle of claim 1, wherein the tissue bundle is a tissue cartridge having two cutouts, such that the tissue cartridge is configured to engage with two securing ridges disposed on the main unit.

9. A wearable tissue receptacle comprising:
a main unit having:
a lower part; and
a ribbed bridge disposed on the lower part, the ribbed bridge having two end portions and a middle portion disposed between the two end portions, the ribbed bridge comprising a plurality of ribs, wherein ribs disposed at the end portions of the ribbed bridge are shorter than ribs disposed at the middle portion of the ribbed bridge, such that the ribbed bridge forms a rounded arch;

a strap configured to be attached to the main unit, wherein the strap is configured to secure the main unit to a user;

a securing ridge disposed on the main unit and a securing cavity disposed on the main unit, wherein the securing ridge is configured to be selectively engaged with the securing cavity to secure a tissue bundle to the main unit.

10. The wearable tissue receptacle of claim 9, wherein the strap is attached to the main unit such that the strap and main unit are a monolithic structure.

11. The main unit of claim 9, further comprising a pair of strap loops, wherein the strap is configured to be partially nested within each strap loop of the pair of strap loops.

12. The wearable tissue receptacle of claim 9, wherein each rib of the plurality of ribs is separated by a rib gap, such that the ribbed bridge is configured to allow air to travel between each rib of the ribbed bridge.

13. The main unit of claim 9, further comprising a pair of protruding clasps associated with the lower part, wherein a securing cavity is nested within each protruding clasp, such that each protruding clasp is configured to engage with a corresponding securing ridge to secure a tissue bundle to the main unit.

14. The wearable tissue receptacle of claim 9, wherein the strap is configured to engage with the user's wrist.

15. A wearable tissue receptacle comprising:

a main unit having:

a lower part; and a bridge disposed on the lower part, wherein the bridge comprises two end portions and a middle portion disposed between the two end portions, wherein the middle portion is taller than the end portions;

a strap configured to be attached to the main unit, wherein the strap is configured to secure the main unit to a user;

a securing ridge disposed on the main unit and a securing cavity disposed on the main unit, wherein the securing ridge is configured to be selectively engaged with the securing cavity to secure a tissue bundle to the main unit.

16. The wearable tissue receptacle of claim 15, wherein the bridge is comprised of a plurality of ribs, wherein each rib is separated from adjacent ribs by a corresponding rib gap.

17. The wearable tissue receptacle of claim 15, wherein the bridge forms a rounded arch that protrudes further at the middle portion of the bridge than at the end portions of the bridge.

18. The wearable tissue receptacle of claim 17, wherein the bridge is configured to support a tissue bundle, such that the tissue bundle conforms to the shape of the rounded arch.

19. The main unit of claim 15, further comprising a protruding clasp associated with the lower part, wherein the securing cavity is nested within the protruding clasp, such that the protruding clasp is configured to engage with the securing ridge to secure the tissue bundle to the main unit.

20. The wearable tissue receptacle of claim 15, wherein the strap is configured to engage with the user's wrist.

* * * * *